US010188226B2

(12) United States Patent
Babcock et al.

(10) Patent No.: US 10,188,226 B2
(45) Date of Patent: Jan. 29, 2019

(54) MODULAR COUNTER SERVICES DISPENSING SYSTEM

(71) Applicant: San Jamar, Inc., Elkhorn, WI (US)

(72) Inventors: Katie Babcock, Milton, WI (US); Leah Ujda, Madison, WI (US); William Dorr, Madison, WI (US); Kenny Hsieh, Ann Arbor, MI (US); Vladlena Belozerova, Madison, WI (US); Stephanie Galligan, Sun Prairie, WI (US); Michael Young, Mukwonago, WI (US)

(73) Assignee: San Jamar, Inc., Elkhorn, WI (US)

( * ) Notice: Subject to any disclaimer, the term of this patent is extended or adjusted under 35 U.S.C. 154(b) by 0 days.

(21) Appl. No.: 15/046,628

(22) Filed: Feb. 18, 2016

(65) Prior Publication Data

US 2016/0242576 A1 Aug. 25, 2016

Related U.S. Application Data

(60) Provisional application No. 62/117,792, filed on Feb. 18, 2015.

(51) Int. Cl.
*A47F 10/06* (2006.01)
*B05B 11/00* (2006.01)

(52) U.S. Cl.
CPC ..... *A47F 10/06* (2013.01); *B05B 11/3056* (2013.01)

(58) Field of Classification Search
CPC .... A47F 10/06; A47F 1/04; A47F 1/06; A47F 1/08; A47F 1/14; B05B 11/3056
USPC ..... 211/85.4
See application file for complete search history.

(56) References Cited

U.S. PATENT DOCUMENTS 3,314,700 A * 4/1967 Burrell ..... F16H 55/00 403/385
3,415,554 A * 12/1968 Papayoti ..... E04G 7/24 403/187
4,384,647 A * 5/1983 Schweizer ..... A45C 11/00 206/214
4,406,368 A * 9/1983 Hermes ..... B43M 99/008 206/1.7
4,429,796 A * 2/1984 Sussman ..... B43M 99/008 206/558
4,480,745 A * 11/1984 Loge ..... A47F 5/00 206/443

(Continued)

FOREIGN PATENT DOCUMENTS

DE 202009008409 10/2009
GB 2137602 6/1986

(Continued)

OTHER PUBLICATIONS

GB1602883.9, Search Report dated Jul. 25, 2016, 5 pages.

*Primary Examiner* — Ko H Chan
(74) *Attorney, Agent, or Firm* — Boyle Fredrickson S.C.

(57) ABSTRACT

A food services accessories and consumable user products dispensing system that includes a number of interchangeable modules that selectively cooperate with interchangeable and connectable mount devices. In a preferred embodiment, one or more of the material containers and/or mounting structures include an aesthetic overlay for manipulating the appearance of the dispensing system and/or configuring the dispensing system to better correlate to the aesthetic appearance of the environment.

20 Claims, 22 Drawing Sheets

(56) References Cited

U.S. PATENT DOCUMENTS 4,570,793 A * 2/1986 O'Neil ..... B43M 99/001 206/214
4,941,576 A * 7/1990 Sugarman ..... B43M 99/001 206/214
5,011,018 A * 4/1991 Keffeler ..... B65D 83/0445 206/532
5,163,536 A * 11/1992 Tuhro ..... A47B 87/002 186/44
5,163,549 A * 11/1992 Hayduchok ..... A45C 11/34 206/214
5,713,550 A * 2/1998 Schwarzli ..... G07F 9/10 248/346.02
6,109,707 A * 8/2000 Ozaki ..... G11B 33/0438 312/107
6,588,548 B1 * 7/2003 Dewitt ..... G06F 19/3462 186/2
8,936,226 B2 * 1/2015 Chang ..... A47B 19/00 108/155
2005/0045644 A1 * 3/2005 Tippmann, Sr. ..... A47F 3/0434 220/592.21
2005/0082307 A1 4/2005 Tucker
2008/0035664 A1 * 2/2008 Berger ..... A47F 1/04 221/97
2008/0067900 A1 3/2008 Marshall et al.
2011/0253482 A1 * 10/2011 Purgatorio ..... A47F 10/06 186/38
2011/0256292 A1 * 10/2011 Purgatorio ..... A47J 47/01 426/549
2015/0128398 A1 * 5/2015 Benlevi ..... A47F 10/06 29/426.2

FOREIGN PATENT DOCUMENTS

WO 2001062127 4/2002
WO 2005016079 2/2005
WO 2011030320 3/2011
WO 2012007530 1/2012

* cited by examiner

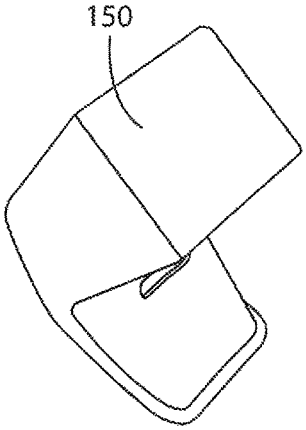
FIG. 13
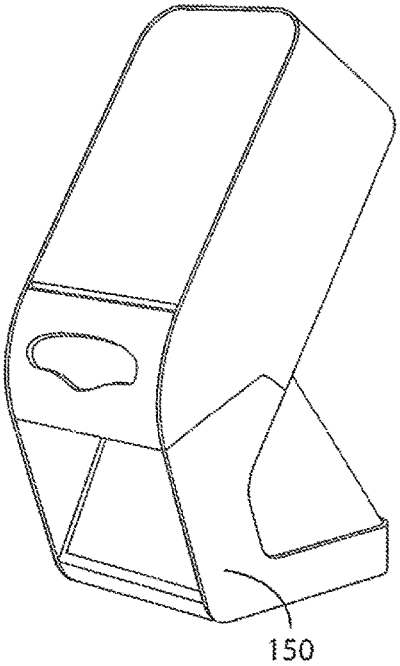
FIG. 14
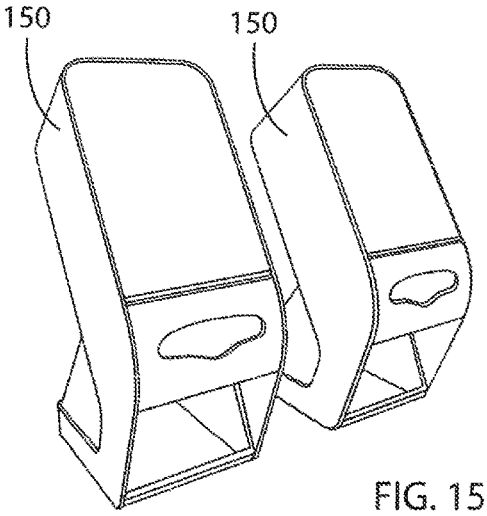
FIG. 15
FIG. 12

MODULAR COUNTER SERVICES DISPENSING SYSTEM

CROSS REFERENCE TO RELATED APPLICATIONS

This application claims priority to U.S. Provisional Patent Application Ser. No. 62/117,792 filed on Feb. 18, 2015 titled "COUNTER SERVICES DISPENSING SYSTEM" and the disclosure of which is incorporated herein.

BACKGROUND OF THE INVENTION

The present application relates generally to a method and system for use in dispensing consumer products proximate a point of use, and more particularly, to a system configured to allow the user, facility, or establishment to individualize the dispensing system to a desired or particular application or environment. The system is further configured to allow the user to select the aesthetic appearance of the dispensing system and the discrete components to correlate to an appearance more closely related to a user's preference or a particular environment associated with implementation of the individually configured dispensing system.

Foodstuffs and drinks are provided to consumers and patrons via many different types of commercial and banquet-type establishments, facilities, restaurants, institutions, cafeterias, and venues. Regardless of the specific vending or distribution methodology, a number of accessories, garnishes, condiments, etc. are commonly supplied by the facility and distributed and/or acquired directly by consumers to satisfy their preferences and/or desires associated with consumption of acquired drinks and foodstuffs.

Accessories common to such environments, depending on the nature of the foodstuffs and/or drinks provided, can include silverware, plastic ware, drinking straws, cup lids, or other eating/drinking utensils/accessories associated with consumption of the foodstuffs. Paper or web material product accessories, such as napkins, wet-wipes, or the like, are also commonly provided. Many facilities also provide garnishes such as cherries, olives, lemons, limes, oranges, pickles, peppers, etc. and/or condiments such as dressings, ketchup, and/or mustard. Some such condiments, such as dressing, dipping sources, ketchup, and mustard, can also be provided as discrete containers or packets or acquired directly from bulk sources. The appearance and presentation of the various accessories, garnishes, condiments, etc. can affect the consumer's opinion of the establishment as well as the efficiency and expediency with which discrete consumers can be served and/or acquire the desired accoutrements during any given interaction with a respective facility and/or vendor.

The various accessories, garnishes, condiments, etc. are commonly contained in discrete dispensing appliances that are positioned in close proximity to one another or dispersed throughout the environment to facilitate dissemination or dispensing of the desired accessories, garnishes, condiments, etc. Whether associated with a vendor side or a consumer side of the product exchange, the dispensers associated with use or distribution of the various accessories, garnishes, condiments, etc. are not without their respective drawbacks.

Regardless of the status of the person intended to directly interact with the dispensing appliance, whether staff or employees of an establishment or the discrete consumers, such dispensing appliances are commonly uniquely configured to dispense only one or a few selected accessories, garnishes, condiments, etc. That is, many such dispensing appliances are commonly provided in a fixed size and/or shape that render the discrete dispensing appliances ill-suited if not wholly incapable of being reconfigured for use in dispensing another of the accessories, garnishes, condiments, etc. should the need or desire to do so arise.

The generally rigid and fixed construction associated with such dispensers also detracts from shipment and/or storage associated with maintaining a desired number of dispensers. That is, many vending and/or distribution methodologies, such as catering enterprises or the like, frequently do not have a conventional brick and mortar establishment and customarily do not have a static venue presentation and/or product platform such that various different dispensers may be desired or required to dispense different accessories, garnishes, condiments, etc. during different events and/or at different locations and/or to the preferences of different users. Maintaining and/or acquiring a plurality of dispensers associated with dispensing a variety of accessories, garnishes, condiments, etc. and that can satisfy the transportability and aesthetic preferences of a variety of users or consumers can be prohibitively costly.

Still further, many such dispensing appliances are provided in form factors that are selected to provide a generally compact dispenser for providing a desired discrete one of accessories, garnishes, condiments, etc. The form factor associated with one discrete dispenser frequently does not lend visual continuity to the presentation of the multiple dispensers configured to dispense more than one of the accessories, garnishes, condiments, etc. When positioned adjacent one another, the multiple dispensers are commonly provided in various heights, depths, widths, and inclinations that can detract from an aesthetically pleasing presentation of multiple dispensers. The presentation of a plurality of dispensers that have different sizes, shapes, and contours can also detract from the visual continuity associated with a particular environment.

Further still, although adjacent dispensers can be configured to dispense a variety of the accessories, garnishes, condiments, etc. associated with a given environment or application, the various dispensers are commonly simply positioned adjacent one another. User interaction with any one dispenser can result in translation of the discrete dispenser relative to support surfaces as well as adjacent dispensers. The discrete translation of a given dispenser relative to adjacent dispensers and/or the supporting surface can detract from the visual continuity associated with the dispenser arrangement and can adversely affect the stability of the discrete dispenser as well as any adjacent dispensers via undesired physical interaction between adjacent discrete dispensers.

Therefore, there is a need for a food and drink services dispensing system that can be individually configured to dispense one or a group of various accessories, garnishes, condiments, etc. There is a further need for food services dispensing systems that include dispensers that can selectively physically connected to one another. There is also a need for food services dispensing system having a selectable, adjustable, or variable aesthetic appearance to satisfy the unique demands or expectations of a variety of users and suitable for use in a variety of environments. It is also preferably desired to provide a food services dispensing system that includes a plurality of components that are one or more of nestable and/or collapsible to facilitate efficient transport, storage, and deployment of the discrete dispensers. Preferably, each dispenser associated with the dispensing system is configured to dispense a plurality of various discrete accessories, garnishes, condiments, etc. in a sanitary and efficient manner.

SUMMARY OF THE INVENTION

The present application discloses a food services dispensing system that addresses one or more of the shortcomings disclosed above. One aspect of the present invention discloses a food services accessories and consumable user products dispensing system that includes a number of interchangeable modules that selectively cooperate with interchangeable and connectable mount devices. In a preferred embodiment, one or more of the material containers and/or mounting structures include an aesthetic overlay for manipulating the appearance of the dispensing system and/or configuring the dispensing system to better correlate to the aesthetic appearance of the environment.

Another aspect of the present invention that is useable or combinable with one or more of the above features or aspects discloses a food services accessory dispensing system that includes a first base portion and a plurality of dispensing containers that are each configured to dispense a different food service accessory. Each of the plurality of dispensing containers is constructed to removably cooperate with the first base portion. The system includes a second base portion that is constructed to removably cooperate with the first base portion and constructed to cooperate with at least one of the plurality of dispensing containers such that the dispensing system can be individualized by discrete users.

Another aspect of the present application that is useable or combinable with one or more of the above features or aspects discloses a method of presenting food service consumer materials. A plurality of connectable base modules and a plurality of dispensing modules are provided. Each of the dispensing modules is configured to contain and dispense consumer food service materials and constructed to cooperate with at least one of the plurality of connectable base modules.

Another aspect of the invention that is useable or combinable with one or more of the above aspects and features discloses a modular food services dispensing system that includes a base and a space frame that is constructed to removably cooperate with the base such that, when engaged with the base, the space frame is oriented at an inclined orientation relative to a rearward direction and relative to the base. The system includes at least one dispensing container that is constructed to removably cooperate with the space frame. A brace is engaged with the base and extends in a generally upward direction between the base and the space frame.

These and various other aspects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout and in which:

FIGS. 12-15 are various perspective views of the dispenser shown in FIGS. 9 and 11 and alternate external aesthetics that can be associated therewith;

Figure 1:
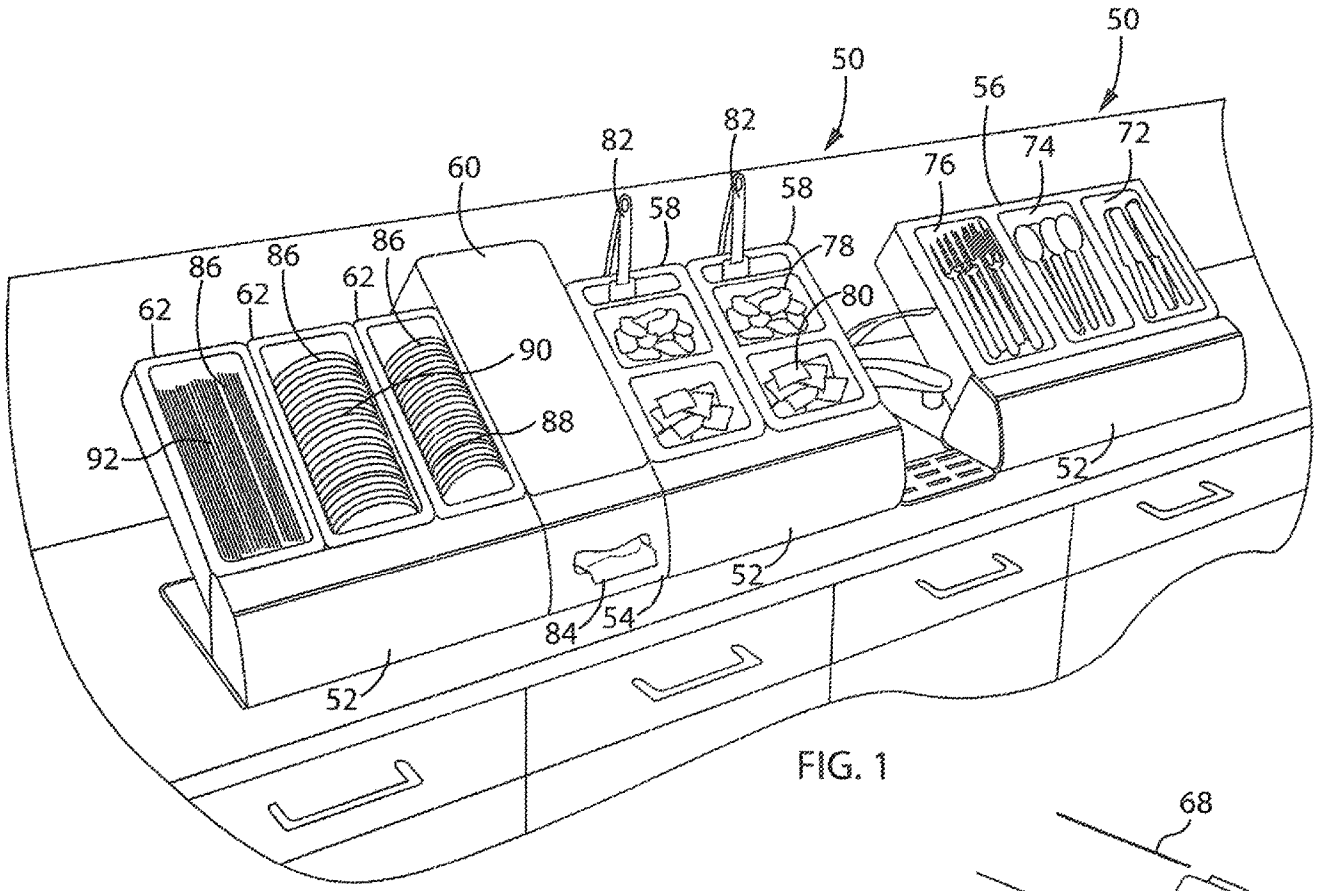
FIG. 1 is a perspective view of various dispensers according to the present invention oriented relative to one another to define a dispensing station or location.

Before explaining embodiments of the invention in detail, it is to be understood that the invention is not limited in its application to the details of construction and the arrangement of the components set forth in the following description or illustrated in the drawings. The invention is capable of other embodiments or being practiced or carried out in various ways. Also, it is to be understood that the phraseology and terminology employed herein is for the purpose of description and should not be regarded as nor is it intended to be limiting.

DETAILED DESCRIPTION OF THE PREFERRED EMBODIMENTS

FIGS. 1-31 show various features, aspects, embodiments, and configurations of a service environment dispensing system 50 according to the present invention. It is appreciated that service environment dispensing system 50 can be deployed to be accessible to service personnel such as wait staff, bartenders, or the like, and/or directly accessible to consumers to provide various service related accessories—such as paper products like napkins or the like; liquid and solid food stuff condiments; such as ketchup, mustard, pickles, onions, tomatoes, etc.; silver and/or plastic ware, cups, cup lids, straws, etc. Understandably, the list above is merely exemplary and is in no way intended to be all inclusive of service industry accessories, garnishes, condiments, etc. provided during consumption and dispersion of food and drink stuffs in any number of environments.

Figure 2:
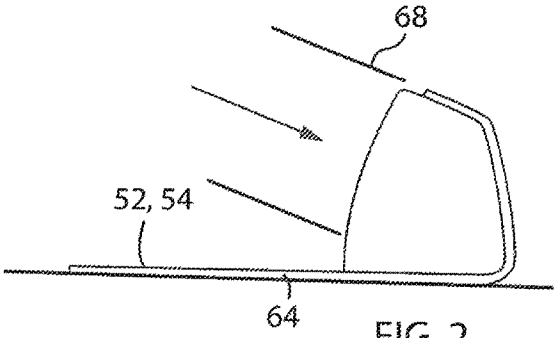
FIG. 2 is a side elevation view of a base of one of the dispensers shown in FIG. 1.

FIG. 1 shows deployment of various discrete dispensing assemblies, devices, or appliances to form a multiple accessory, condiment, garnish, etc., dispensing system 50 according to the present invention. Each dispensing device includes at least one respective base or base portion 52, 54 that is constructed to accommodate one or more dispensing containers 56, 58, 60, 62. Referring to FIGS. 1 and 2, each base portion 52, 54 is defined by a body 64 that is shaped to slidably or removably cooperate with a one or more dispensing containers or accessories 68.

As shown in FIG. 1, each base portion 52, 54 is constructed to cooperate with one or more respective dispensing containers 56, 58, 60, 62 wherein each dispensing container 56, 58, 60, 62 can be configured to accommodate dispensing of different items. For instance, dispensing container 56 includes a plurality of cavities 72, 74, 76 configured to accommodate alternate generally elongated food service accessories such as straws, silverware, or plastic ware. Dispensing containers 58 are constructed to include a plurality of cavities 78, 80 and to support a dispensing appliance such as a tongs 82. Cavities 78, 80, and the association of tongs 82 therewith, are configured for dispensing foodstuffs, such as pickles, onions, or other solid food and drink stuff condiments and garnishes, in a substantially sanitary manner.

Still referring to FIG. 1, base portion 54 includes an opening 84 that is shaped to cooperate with an opening defined by a dispensing container 60 associated with containing paper products or the like or other products configured to be dispensed in a pass-through manner. It is further appreciated that container 62 need not include a distinct pass through opening and can alternatively be constructed to cooperate with base portion 54 wherein the base portion, and the opening 84 associated therewith, defines the faceplate associated with dispensing of pass through products.

Dispensing container 62 defines cavities 86 shaped to accommodate dispensing of other foodstuffs related accessories, such as cup lids 88, 90 and/or straws 92. As explained further below, each base portions 52, 54 is constructed to cooperate with another adjacent base portion 52, 54 and configured to be secured to one another so as to generate a generally uniform and continuous presentation of plurality of base portions and the various dispensing containers associated therewith.

Figure 3:
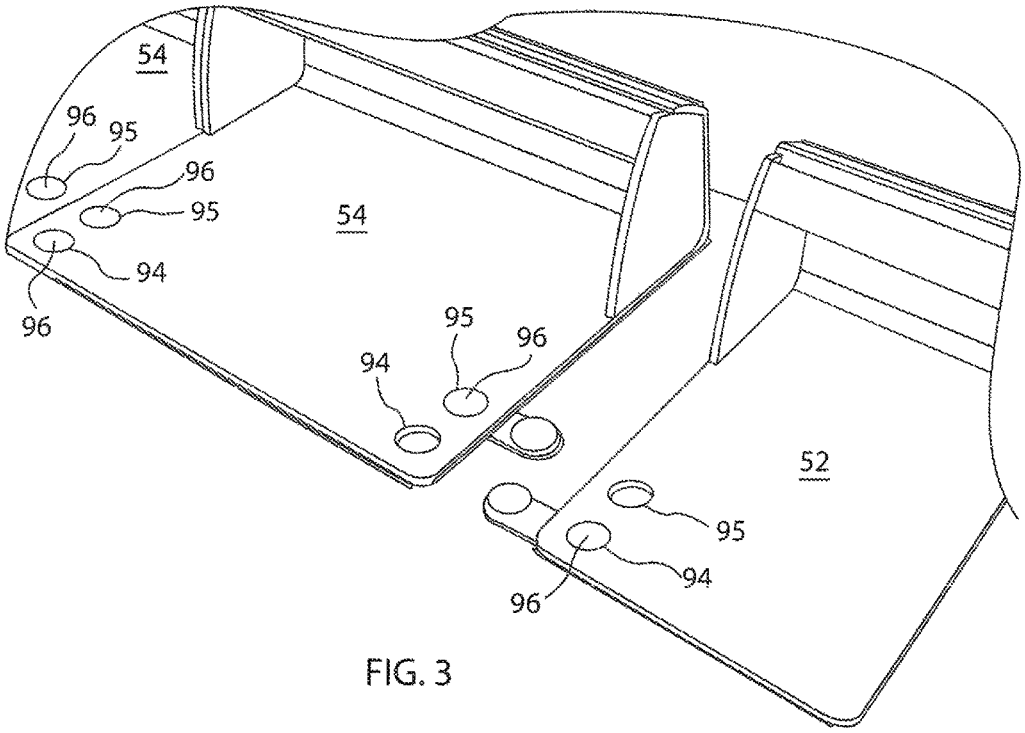
FIG. 3 is a rear perspective view of a pair of bases associated with the dispensing system shown in FIG. 1 and separated from one another.

As shown in FIG. 3, base portions 52, 54 include one or more openings 94, 95 that are each constructed to cooperate with a fastener or connector 96 to accommodate side-by-side securing of multiple base portions 52, 54 relative to one another. Although shown as being associated with only a generally rearward portion of the respective base portions 52, 54, it is further appreciated, as disclosed further below with respect to FIGS. 20-27, that base portions 52, 54 can be provided with additional securing structures associated with connecting adjacent base portions.

It is further appreciated that, base portions 52, 54 can be provided in any number of shapes and/or configurations and/or shaped to accommodate or support only one or a plurality of respective dispensing containers. It is further appreciated that the respective containers can be configured to dispense only one commodity or accessory or a number of related accessories—such as knives, spoons, and forks; and/or only those commodities or accessories common or desired to be dispensed in a particular environment.

Still referring to FIG. 3, it is further appreciated that one or more of connectors 96 can be removable from one or both of respective adjacent base portions 52, 54 so as to accommodate the use of connectors 96 at alternate lateral ends of respective base portions 52, 54 intended to be connected to one another. It is further appreciated that the respective base portions could include cooperating structures for securing adjacent base portions to one another to satisfy a given presentation requirements. In a preferred embodiment, the respective connectors are provided in form factor wherein the respective connectors provide a finished appearance to the respective base portions with which they are engaged whether the respective base portion is deployed as a single unit configuration or engaged with one or more laterally adjacent base portions.

Preferably openings 94, 95 and connectors 96 cooperate with one another so as to generally align the forward oriented edge associated with the respective connected base portions 52, 54. Providing multiple base portions 52, 54 having alternate constructions and multiple dispensing containers 56, 58, 60, 62 that are each constructed to cooperate with alternate base portions 52, 54 provides a degree of modularity with respect to service system 50 which allows the user or facility associated with implementation of system 50 to configure system 50 for use in their intended environment and/or necessary application and further allows system 50 to provide a plurality of components that can be uniquely configured to satisfy the demands of different user desires. That is, the user need not invest in dispensing arrangement features that may not be germane to their particular needs or desires.

Figure 4:
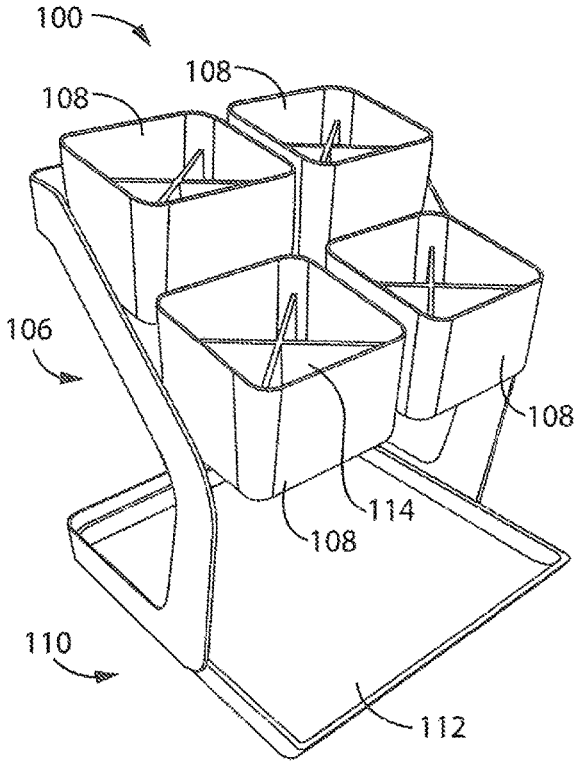
FIG. 4 is a forward perspective view of another dispenser assembly according to the present invention.
Figure 5:
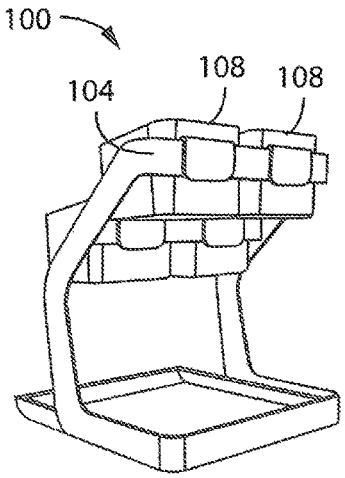
FIG. 5 is a rear perspective view of the dispenser assembly shown in FIG. 4.
Figure 6:
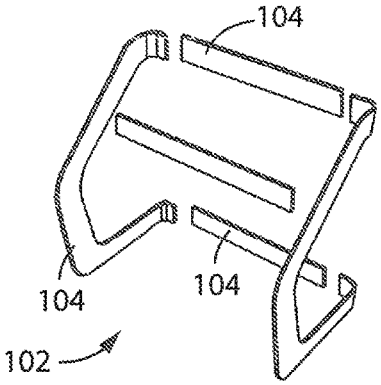
FIG. 6 is a perspective view of a frame portion of the dispenser assembly shown in FIG. 4 with a pan associated with the base and a plurality of dispenser containers removed therefrom.

FIGS. 4-6 show an elevated dispensing arrangement 100 associated with an alternate embodiment of the present invention. Arrangement 100 includes an interconnected base, base portion, or support assembly 102 that includes a plurality of interconnected links 104 (FIG. 6) that, when secured to one another, define an elevated presentation platform 106 configured to support a plurality of accessory dispensing containers 108. The modularity associated with support assembly allows arrangement 100 to achieve a substantially compact orientation when not in use, during, transport, and/or shipping. It is further appreciated that each accessory dispensing container 108 can be partitioned so as to accommodate dispensing and the intended sanitary presentation of a plurality of accessories with a single or multiple accessory containers. It is further appreciated that containers 108, and any partitions associated therewith, can also be provided in a collapsible or nestable configuration so as to further facilitate the compact nature of arrangement 100 when not in use.

Referring to FIG. 5, each container 108 is constructed to slideably cooperate with a respective member or link 104 associated with support assembly 102. A lower portion 110 of support assembly 102 is constructed to cooperate with base portion or platform 112. Platform 112 is preferably configured to accommodate presentation of one or more accessories and/or presentation of one or more additional accessory dispensing containers associated with support system or arrangement 100. It should be further noted that arrangement 100 includes a number of partition walls 114 that have a similar aesthetic appearance and finish with respect to platform 112 such that, although provided in a module paradigm, the dispensing system or arrangement 100 is provided in a methodology that lends continuity between the respective features of the system and can be configured to accommodate or compliment the aesthetics of the environment.

Figure 7:
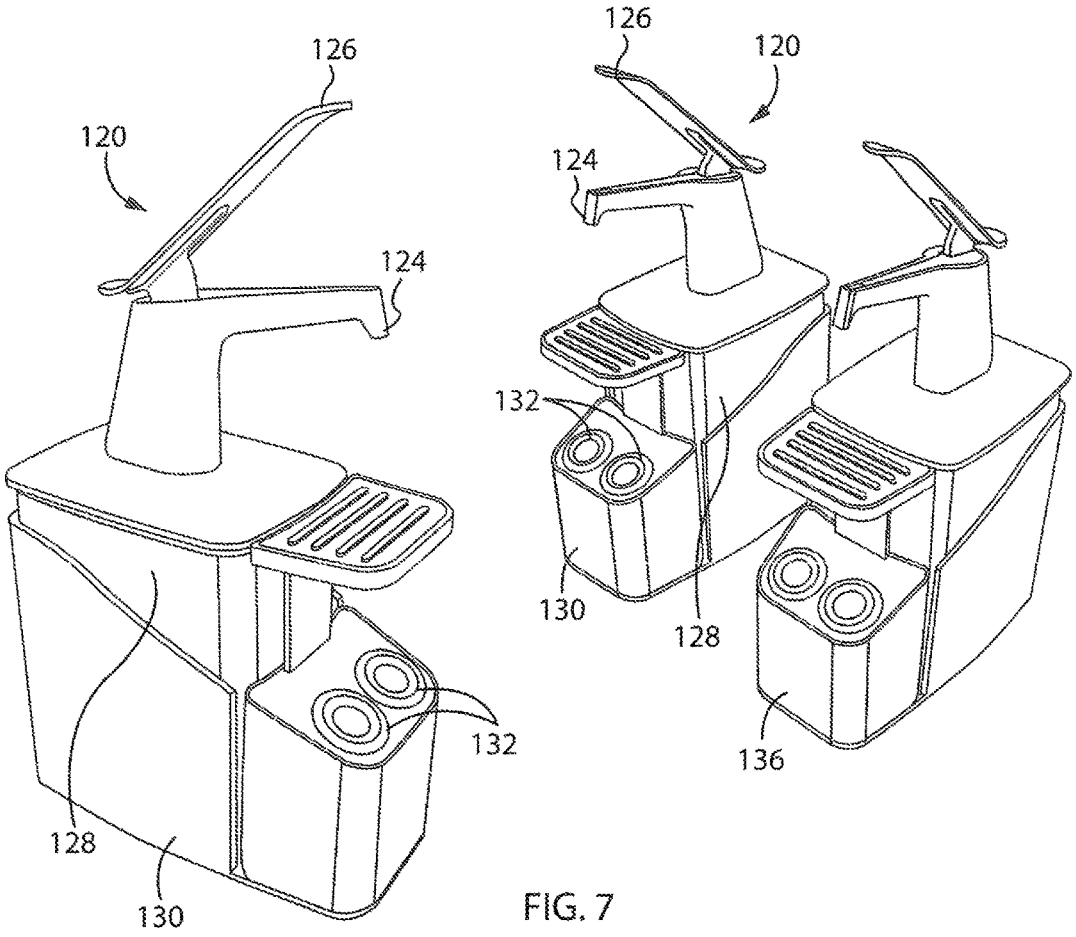
FIG. 7 includes various perspective views of a bulk material dispenser assembly that can be associated with the dispenser system shown in FIG. 1.
Figure 8:
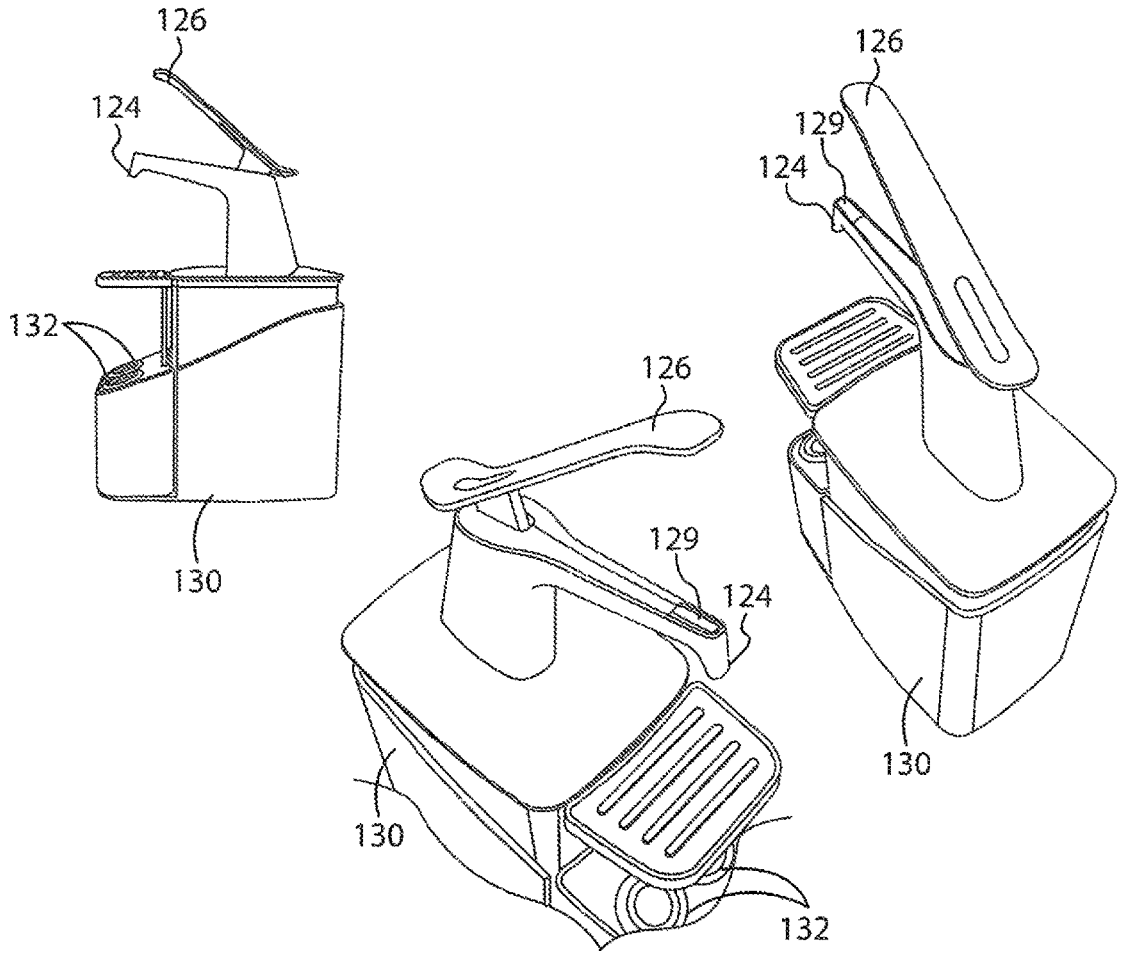
FIG. 8 are various additional perspective views of the bulk material dispenser shown in FIG. 7.
Figure 9:
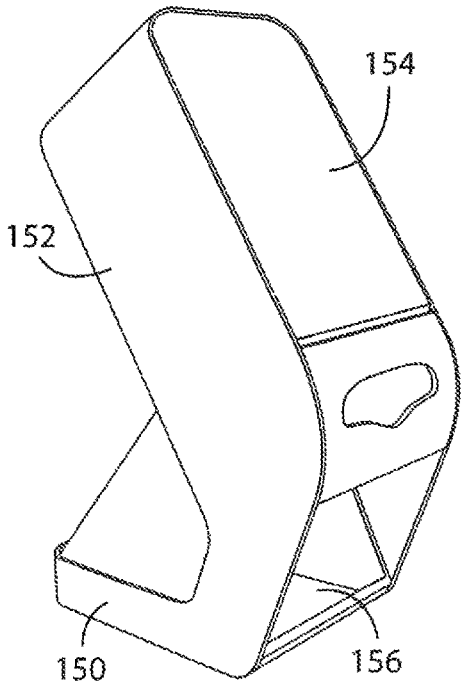
FIGS. 9-11 are various perspective views of a paper product dispenser usable with the dispenser system shown in FIG. 1.

FIGS. 7-8 show various views of an additional dispensing accessory 120 that can be selectively associated with one or more of the components of system 50. As should be readily appreciable, dispensing accessory 120 is commonly understood as a pump dispenser configured for dispensing generally fluid food condiments—such as ketchup, mustard, dressings, sauces, etc. Pump dispenser accessory 120 includes a spout 124 configured to dispense a food product upon actuation of a handle 126. Reservoir 128 holds a volume of a particular fluid food condiment such that actuation of handle 126 delivers the product to spout 124 for subsequent delivery of the food product to other food stuffs or a portable container disposed generally under spout 124. It is appreciated that dispensing accessory can be configured for both manual and/or automatic operation. It is further appreciated that accessory 120 can include one or more indicia or indicators 129 associated with identifying the contents of reservoir 128.

Reservoir 128 slidably cooperates with a base portion 130 that can include respective cavities 132 for dispensing optional disposable product cups. As should be appreciated from a comparison of FIGS. 4-8, base, base portion, or platform 112, partition walls 114, handle 126, and base portion 130 have finishes that generally correlate to one another so as to provide an indication as to the relatedness of respective portions of system 50.

FIGS. 9-15 show various views of an additional dispenser assembly, arrangement or component 150 associated and usable with system 50 and constructed according to the present invention. The multiple dispenser component 150 includes a base or base portion 152 that is constructed to accommodate a first dispenser 154 and a second dispenser and/or a product contained therein 156. In an alternate configuration, a base portion or base 160 is constructed to include alternate faceplates 162, 164 that each define an opening 166, 168 associated with dispensing pull through products, such as napkins or the like, from a container and associated cover 170 associated with base 160.

Figure 11:
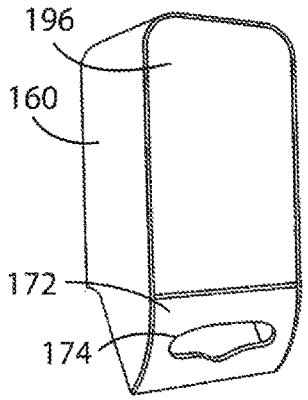
Figure 10:
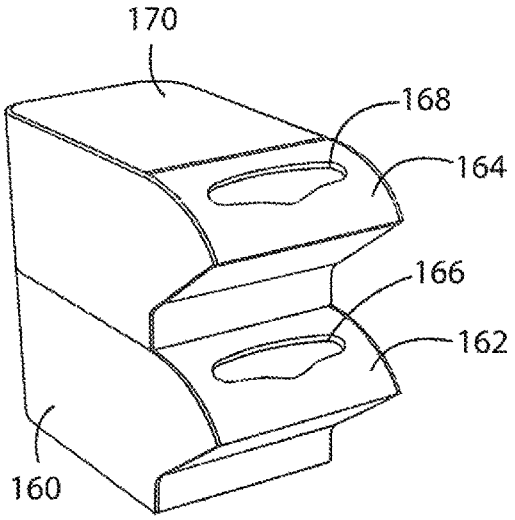
Figure 16:
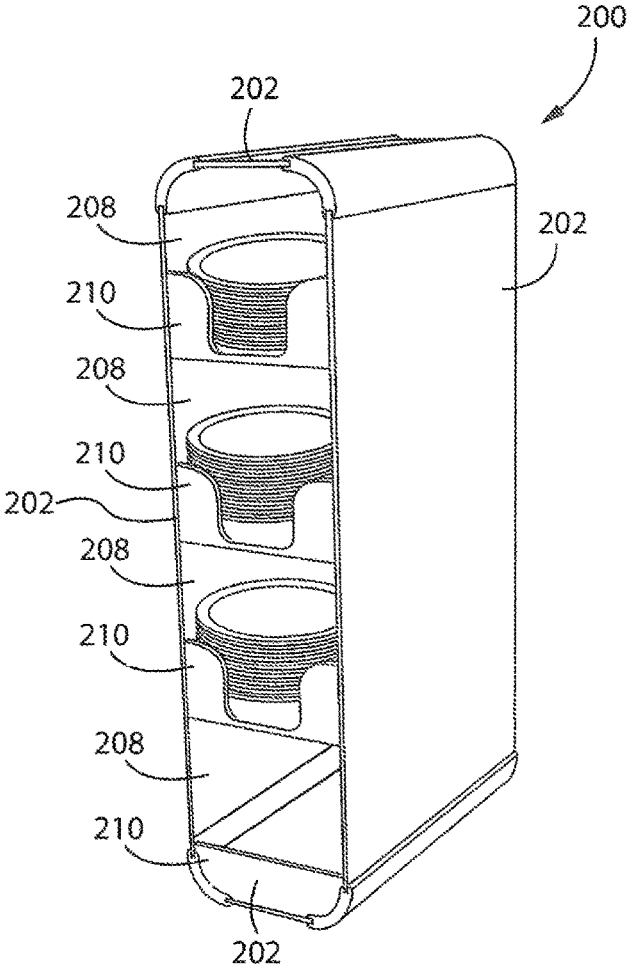
FIG. 16 is a perspective view of another embodiment of a dispenser assembly associated with the dispenser system shown in FIG. 1.
Figure 17:
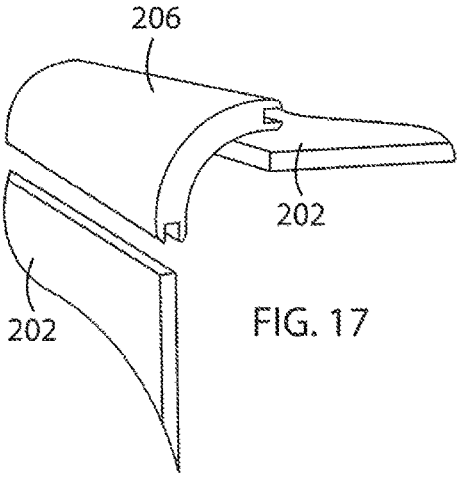
FIG. 17 is a perspective view of a corner assembly associated with the dispenser assembly shown in FIG. 16.

It is further appreciated that base portion or base 160 can be provided in alternate configurations such as that shown in FIG. 11 wherein a faceplate 172 is oriented in a generally forward facing orientation such that an opening 174 presents paper product disposed behind cover 176 associated with the container defined by base portion or base 160 and in a generally vertical orientation. It is further appreciated that base portions or bases 152, 160 can be configured to interchangeably cooperate with one another and/or be securable to one another while maintaining generally the same or a complimentary aesthetic appearance associated with the wood grained finish between the alternate accessories.

Referring to FIGS. 12 and 15, it is further appreciated that base 152 that can be provided in various alternate finishes as well so as to manipulate the aesthetic appearance associated with various components of system 50. That is, it is appreciated that the various components of system 50 can be provided in various finishes and/or complimentary colors or arrangements so as to coordinate with the environment in which the system is deployed. It is further appreciated that each of bases 152, 160 can include a connector and/or be configured to cooperate with respective connectors 96 to facilitate the relative connection of a respective paper product dispensing component 150 and a laterally adjacent accessory dispenser.

FIGS. 16-19 show various additional dispensing accessories 200, 250, 300 that can be selectively included in any respective deployment of system 50. Accessory 200 includes a generally panelized construction consisting of a number of panels 202 that can selectively be secured to one another via discrete corner elements 206 so as to define a multiple cavity 208 dispensing tower wherein the plurality of cavities are vertically oriented relative to one another. It is further appreciated that faceplates 210 could be shaped and/or manipulated so as to accommodate horizontal deployment of accessory 200 and provide a respective designation as to such deployment or the intended deployment associated therewith. It is further appreciated that accessory 200, like accessories 250 and 300 also be constructed to be interchangeably selectably securable to adjacent bases of related and or similarly appearing products.

Figure 18:
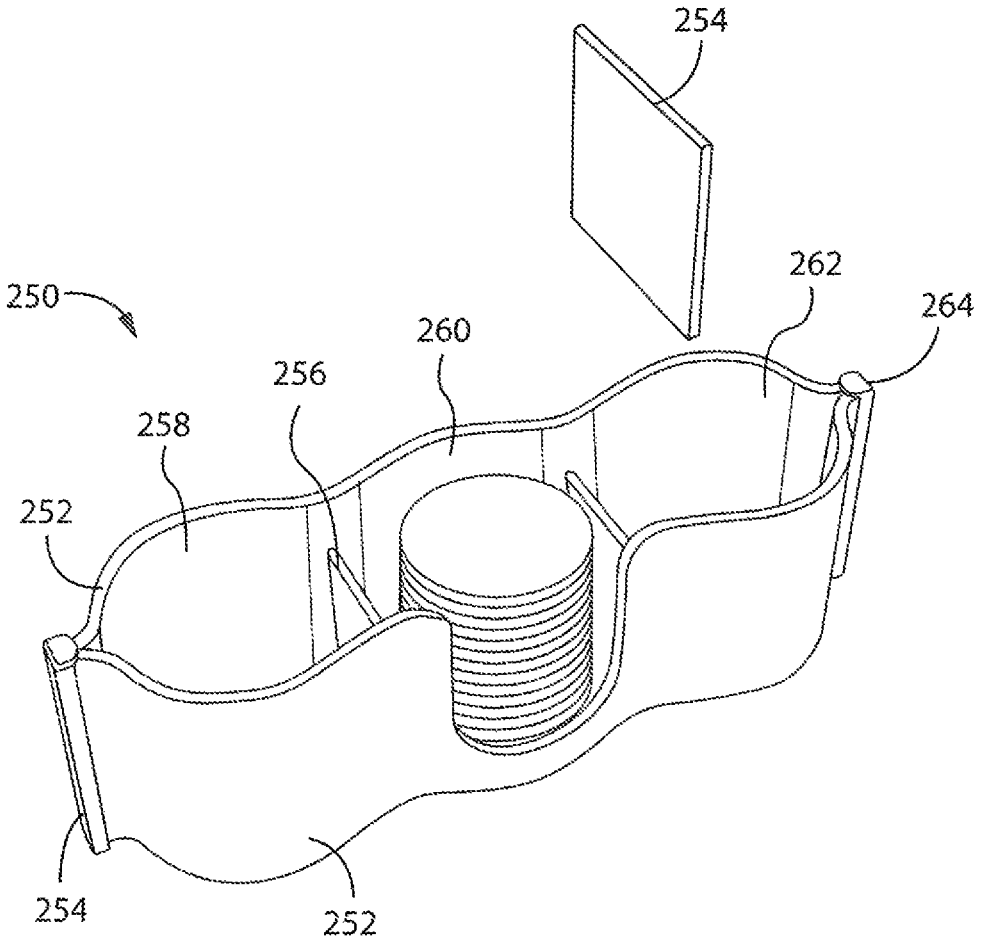
FIG. 18 is a perspective view of another dispenser assembly usable with the dispenser system shown in FIG. 1.

FIG. 18 shows yet another alternate dispenser accessory generally defined by a base portion, base, or body 252 that cooperates with one or more partitions 254, 256 associated with segregating respective portions of body 252 into respective dispensing receptacles or cavities 258, 260, 262. Respective portions of body 252 are connected to one another via a rib 264 engaged with alternate longitudinal ends of the body portions. It is envisioned that the shape and/or respective size as well as the presentation of cavities 258, 260, 262 be presented in a manner that is indicative or intuitive as to the accessories dispensed therefrom and/or a respective association with adjoining dispensing accessories.

Figure 19:
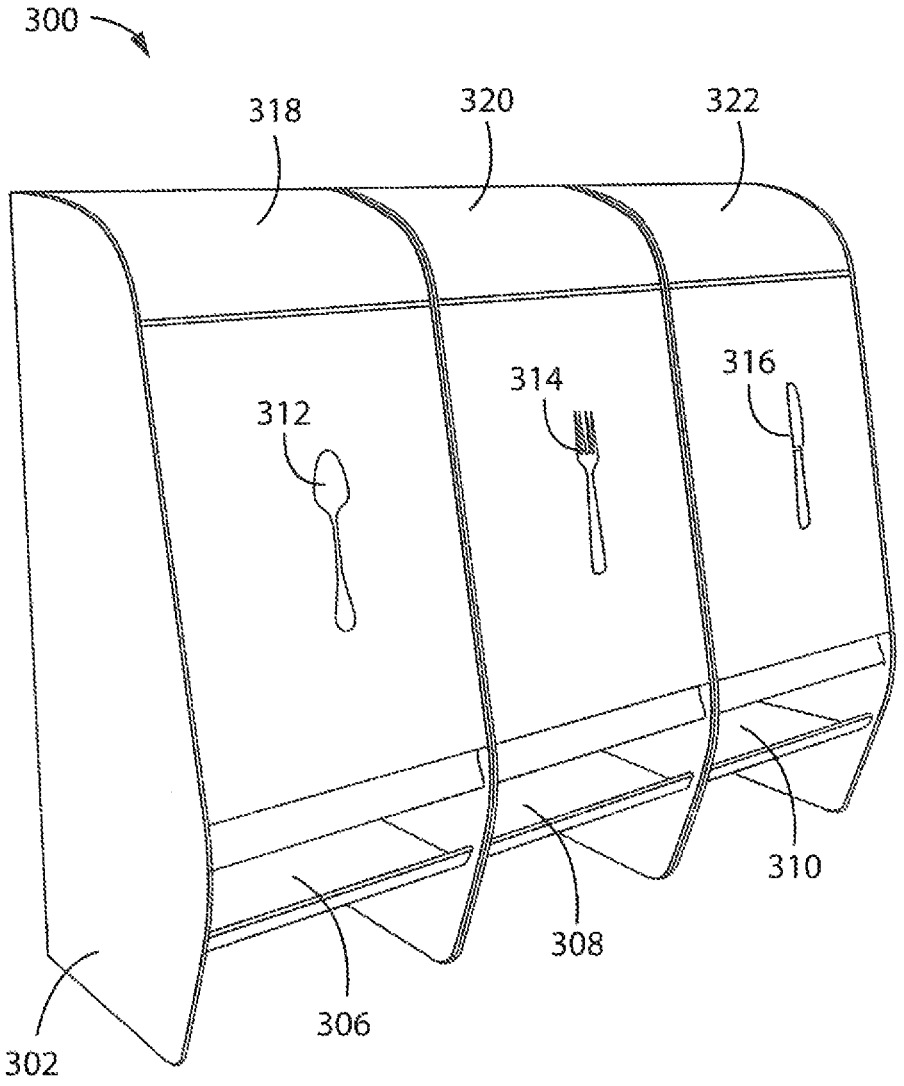
FIG. 19 is a perspective view of another dispenser assembly usable with the dispenser system shown in FIG. 1.

FIG. 19 shows yet another dispensing accessory 300 that is configured to cooperate with one or more of the discrete respective dispensing accessories associated with system 50 as described above. Accessory 300 includes a base portion or base 302 that can include one or more dispense cavities 306, 308, 310 associated with presenting discrete food or other customer service related accessories from dispensing accessory 300. It is further envisioned that accessory 300 can include one or more indicia 312, 314, 316 associated with respective portions thereof so as to provide a written or graphic indication as to the accessories that can be retrieved therefrom. It is appreciated that indicia 312, 314, 316 may be any of a graphical and/or three-dimensional representation indicative of the respective accessories being dispensed therefrom. It is further appreciated that dispensing accessory 300 can include one or more face panels 318, 320, 322 that have an aesthetic appearance that generally correlates to the aesthetic appearance associated with other accessories configured to cooperate with a respective portion of system 50.

FIGS. 20-27 show various views of a dispenser accessory or assembly 350 that is selectively usable with one or more of the dispensing accessories disclosed above or multiple dispensing assemblies 350 for forming a desired food or counter services accessory dispensing system 50. Dispenser assembly 350 includes a base 352 that is defined by a faceplate 354 that extends generally in an upward direction relative to a bottom portion 356. Faceplate 354 and bottom portion 356 can be formed integrally with one another or constructed with a selectively severable connection therebetween. An optional support or brace 358 is attached to a rearward portion 360 of bottom portion 356 of base 352 and extends in a generally upward direction between bottom portion 356 and a dispensing container support arrangement as disclosed further below.

Figure 20:
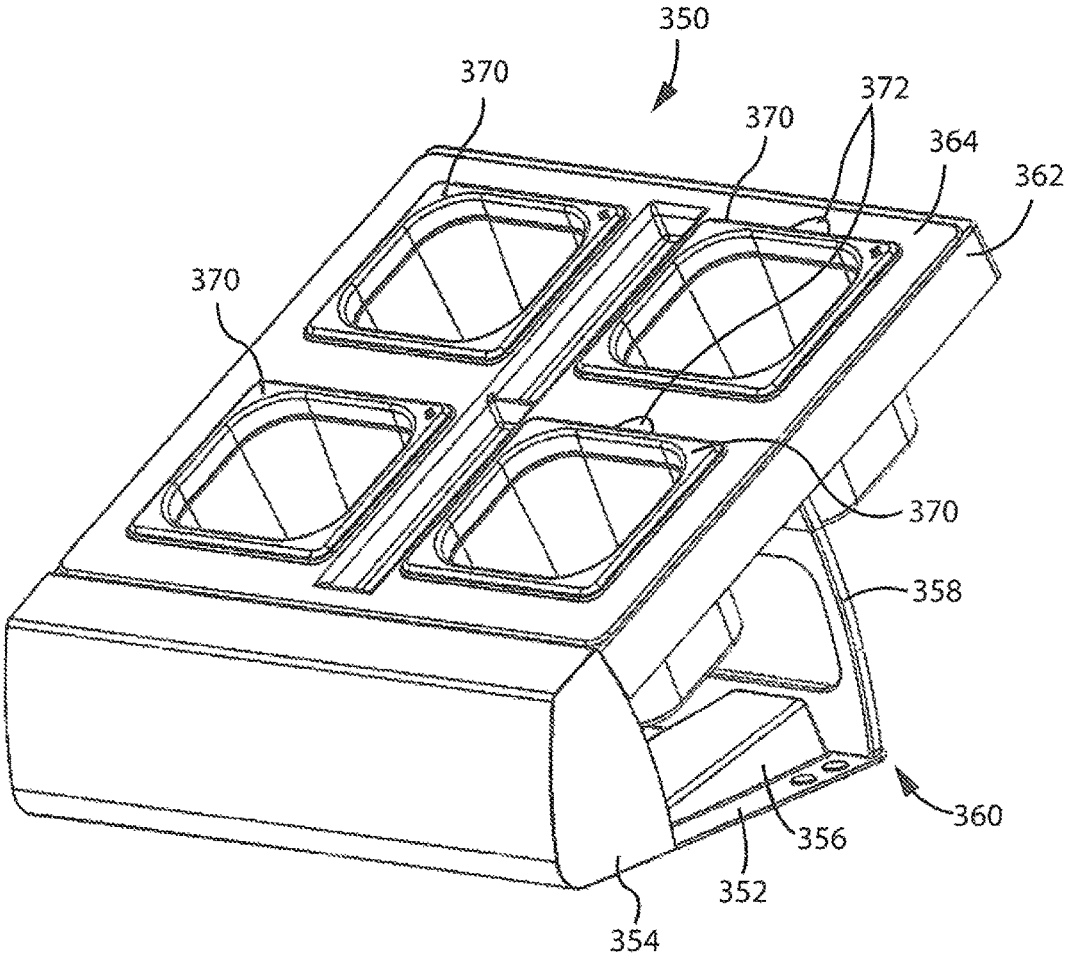
FIG. 20 is a perspective view of another dispenser assembly usable with the dispenser system shown in FIG. 1.
Figure 21:
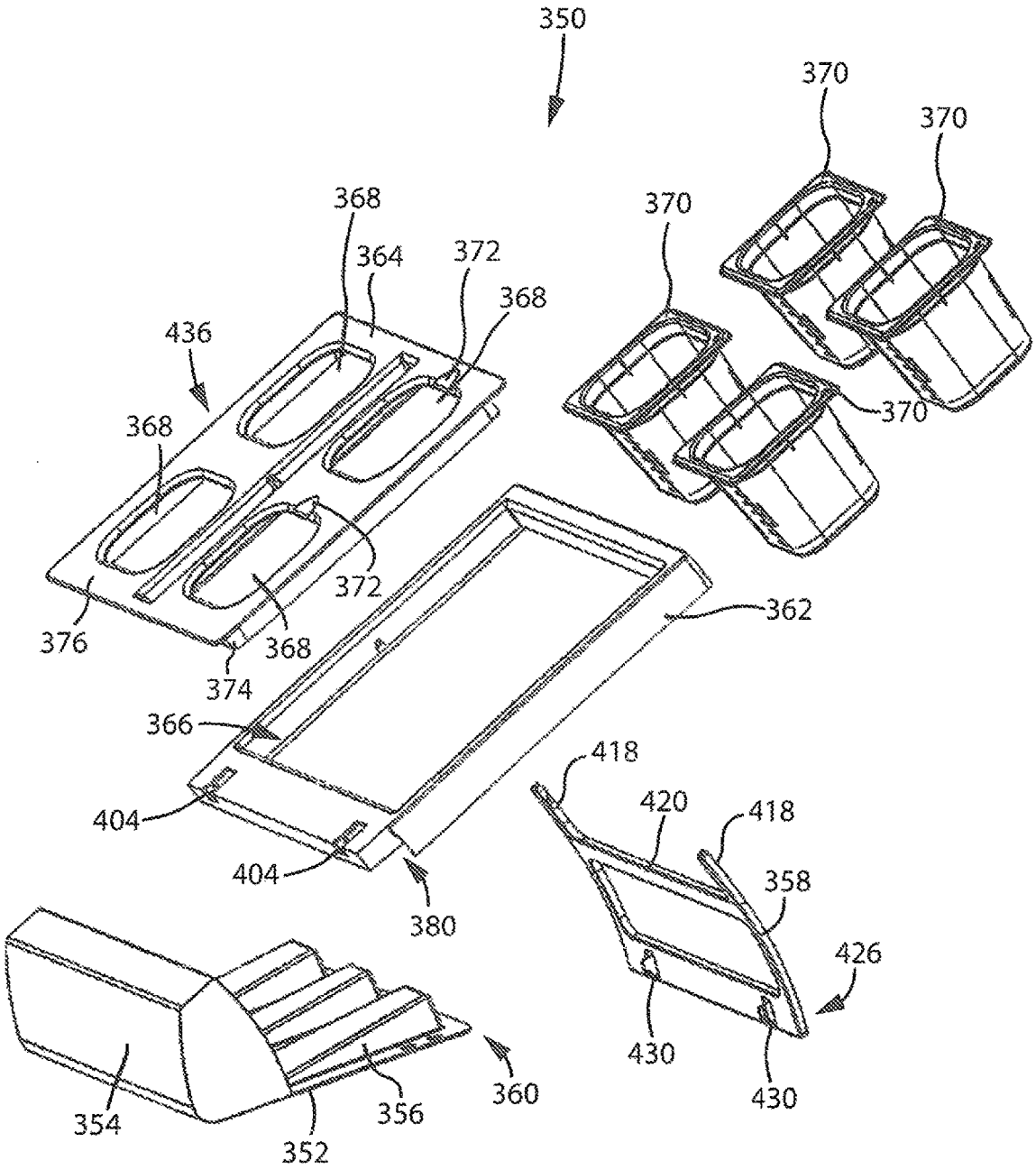
FIG. 21 is an exploded view of the dispenser assembly shown in FIG. 20.
Figure 22:
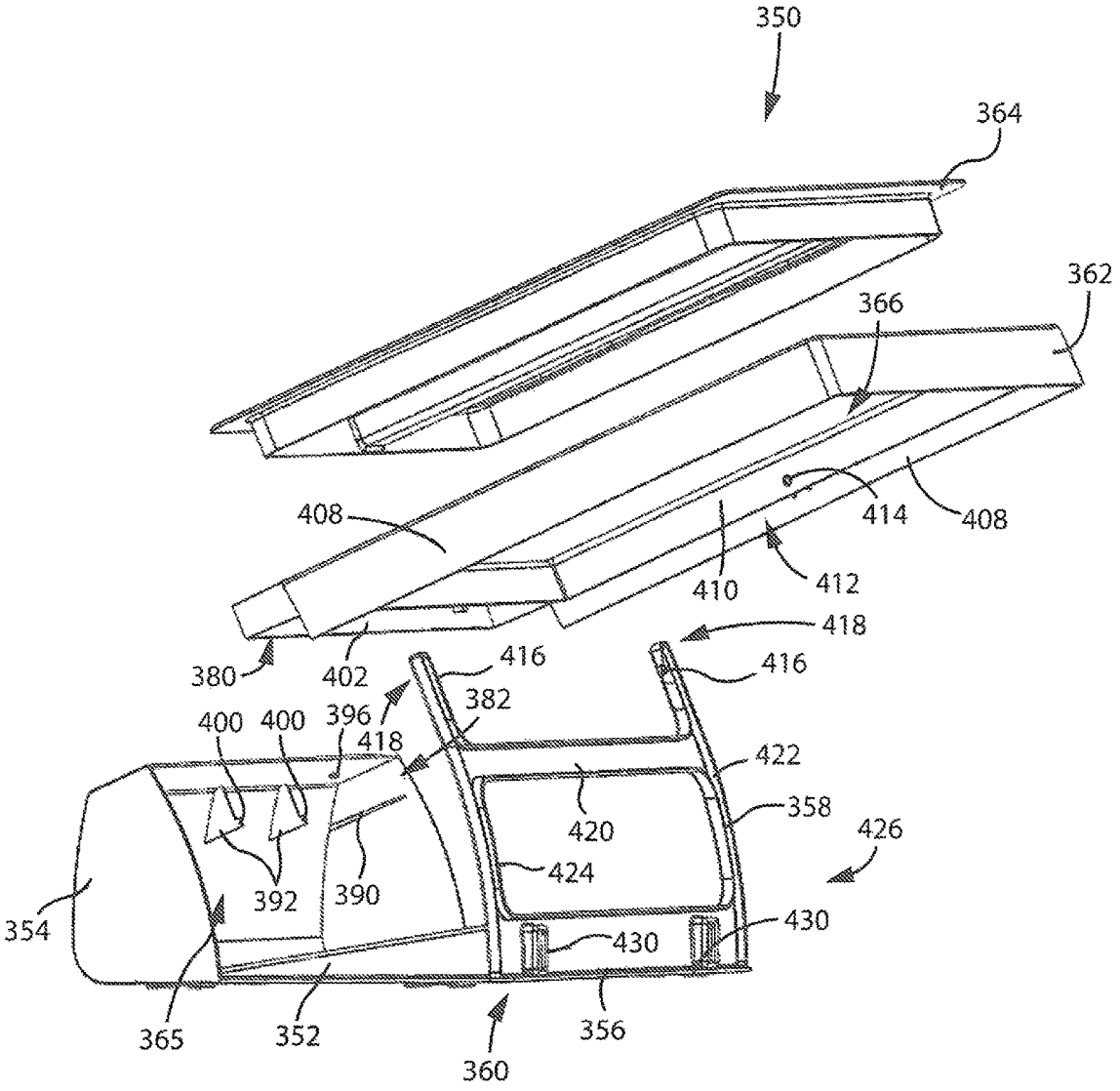
FIG. 22 is a rear perspective exploded view of the dispenser assembly shown in FIG. 20 with the discrete dispenser containers removed therefrom.

Dispenser assembly 350 includes a first bezel 362 that removably cooperates with a rearward facing cavity 365 (FIG. 22) defined by faceplate 354. Referring to FIG. 20-22, dispenser assembly 350 includes a second optional bezel 364 that removably cooperates with an opening 366 defined by first bezel 362. Second bezel 364 includes one or more openings 368 that are shaped to slideably cooperate with respective dispenser containers 370. It is appreciated that first bezel 362 could be constructed to directly cooperate with the respective dispensing containers 370.

Bezel 364 can include one or more fingers or slots 372 associated with effectuating removal of discrete respective containers 370 from bezel 364. Bezel 364 includes a rearward extending flange 374 and a laterally extending flange 376 that slideably cooperate with opening 366 of bezel 362 so as the positionally index bezel 364 relative thereto.

As shown in FIGS. 21-22, bezel 362 includes a forward facing end portion 380 that slideably cooperates with a top portion 382 of cavity 365 defined by faceplate 354. Top portion 382 of cavity 365 includes one or more projections 390, 392, 396 that accommodate the slidable, and preferably a snap-fit, interaction between bezel 362 and faceplate 354. Projections 392 include a barb 400 that is configured to engage a lower edge 402 of end portion 380 of bezel 362. Such a construction ensures a generally planar association of the top surfaces of faceplate 354 and bezel 362 when engaged with one another. As shown in FIG. 21, forward facing end portion 380 of bezel 362 includes one or more cavities or recesses 404 that are preferably constructed to snap fittingly engage respective projections 396 (FIG. 22) associated with the rearward facing side of faceplate 354.

Bezel 362 includes an outer flange 408 and an inner flange 410 that are disposed along at least the opposite lateral sides thereof. A channel 412 is defined between flanges 408, 410 and faces in a generally downward direction toward bottom portion 356 of base 352. A cavity 414 is associated with the respective alternate lateral side inner flanges 410 of bezel 362. Cavity 414 and channel 412 are constructed to cooperate with a projection 416 and an upward extending end portion 418, respectively, associated with the opposite lateral sides of brace 358.

Projections 416 preferably snap-fittingly cooperate with cavity 414, such that end portions 418 of brace 358 are disposed in channel 412. Brace 358 includes a lateral member 420 that extends between opposite vertical portions 422, 424 of brace 358 and which is offset from the respective end portions 418. One or more respective bosses 430 are formed proximate a lower end 426 of brace 358. Bosses 430 are constructed to snap-fittingly cooperate with a rearward facing portion 360 of bottom portion 356 of base 352 such that end portions 418 of brace 358 are offset in a rearward direction relative to faceplate 354 when brace 358 is secured to base 352. When brace 358 is secured to base 352, lateral member 420 of brace 358 is disposed generally below a partition 436 defined by bezel 364 and oriented so as to not interfere with the removable slideable interaction of respective dispensing containers 370 with the bezels associated therewith.

Figure 23:
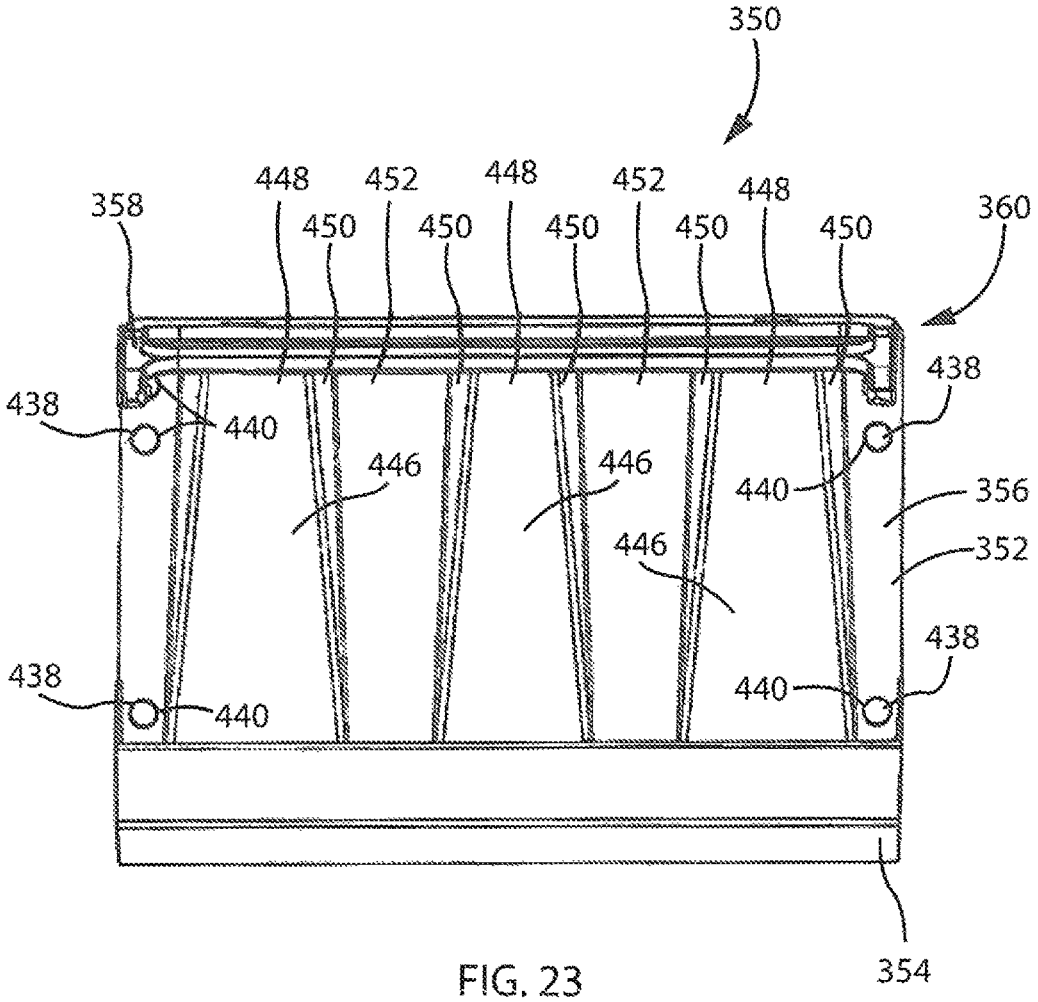
FIG. 23 is a top plan view of a base portion assembly of the dispenser shown in FIG. 20.

Referring to FIGS. 20 and 23, like bases 52, 54, one or more connectors 438 cooperate with respective openings 440 defined by base 352. Connectors 438 can be configured to cooperate with a pair of adjacent openings 440 associated with a single base 352 and/or have one end thereof disengaged from a respective base so as to engage a respective opening associated with an adjacent base such that various combinations of bases 52, 54, 352 can be secured relative to one another during formation of a desired configuration of dispensing system 50.

Referring to FIG. 23, bottom portion 356 of base 352 includes one or more contoured sections 446 that are each defined by an elevated portion 448, opposite facing sidewall portions 450, and a respective intermediary or valley portion 452 formed between adjacent contoured sections 446. Respective contour sections 446 are shaped to facilitate drainage of base 352 should any liquid material be impinged thereupon during use, placement, and/or removal of the respective dispensing containers relative to assembly 350.

Figure 24:
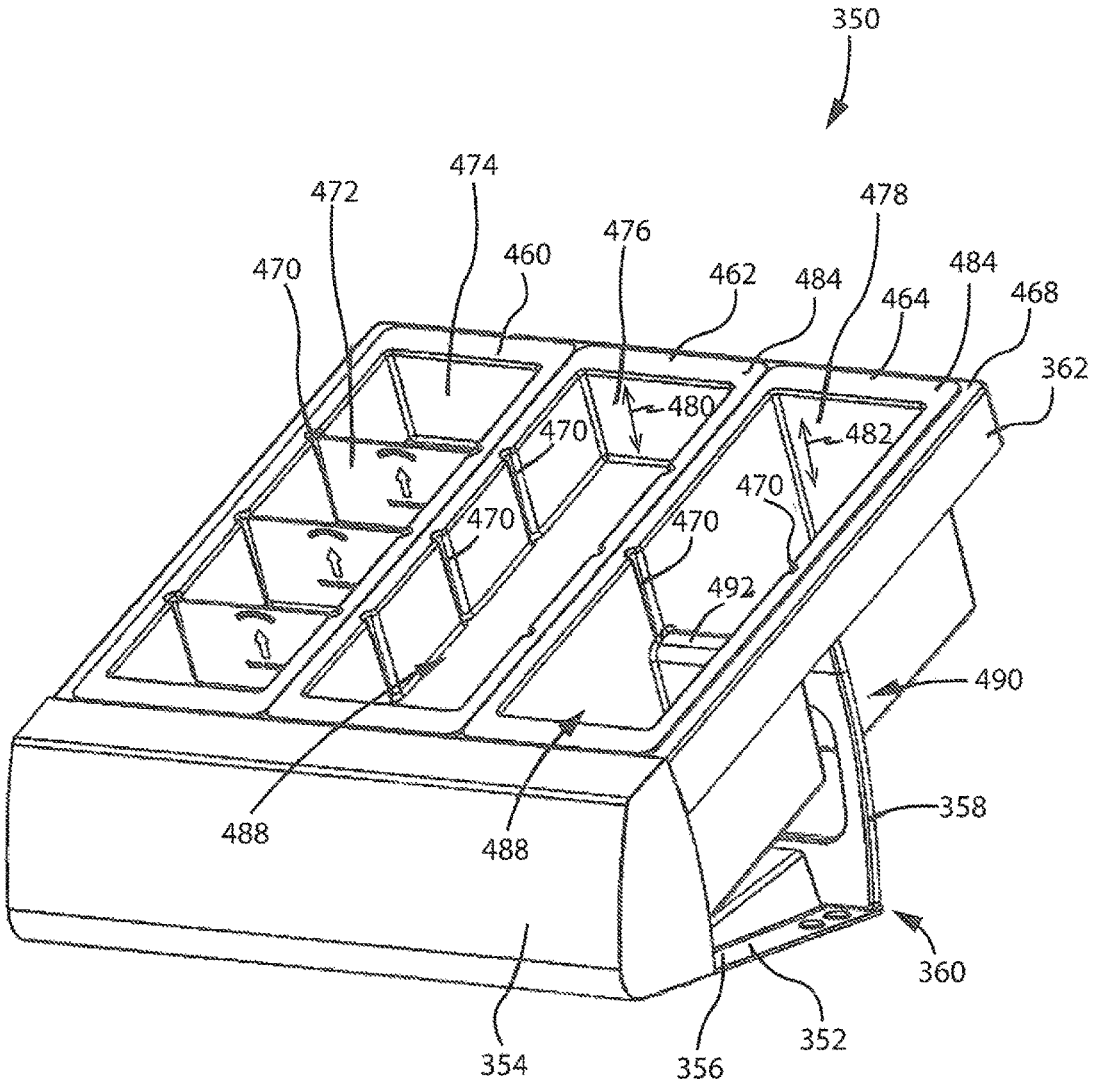
FIG. 24 is a view similar to FIG. 20 of another dispenser assembly useable with the dispenser system shown in FIG. 1.
Figure 25:
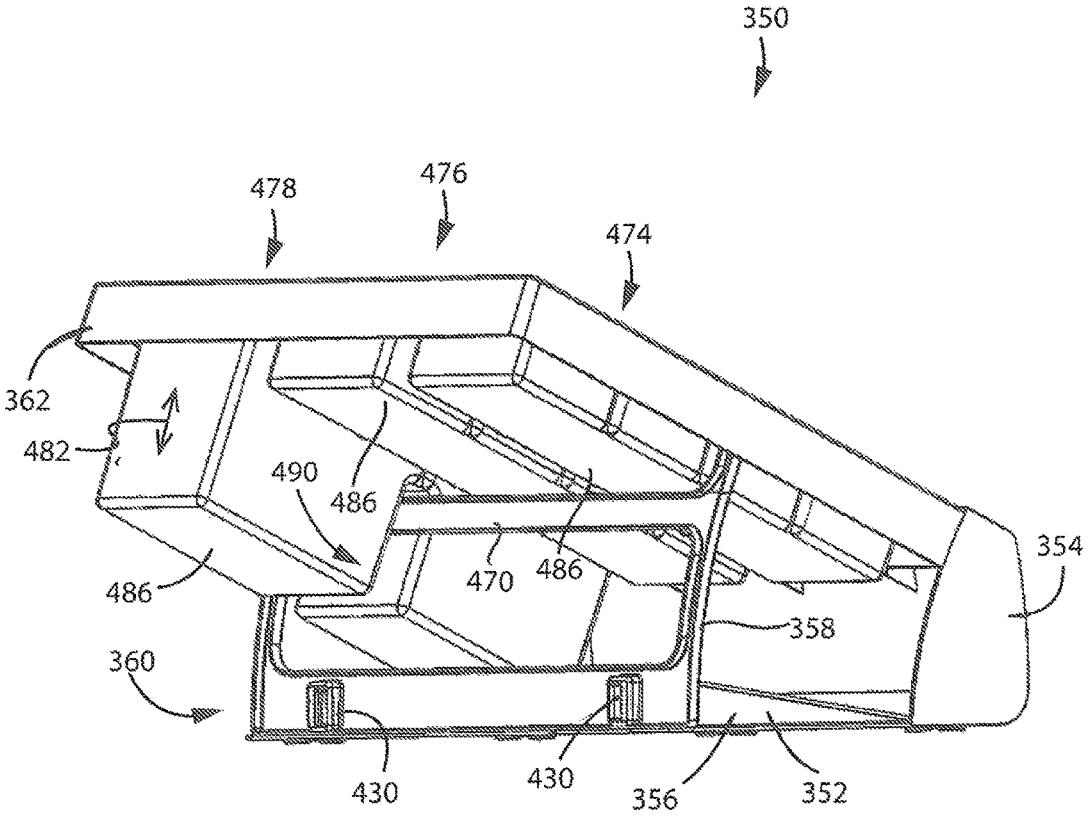
FIG. 25 is a rear perspective view of the dispenser assembly shown in FIG. 24.

Referring to FIGS. 24-27, it should be appreciated that base 352 and bezel 362 are constructed to accommodate various dispenser appliances or devices, aside from containers 370, and that such devices can be provided in various shapes, sizes, and configurations. Referring to FIGS. 24-25, dispenser assembly 350 is shown configured to accommodate alternate commodity containers 460, 462, 464 that are slideably associated with the top surface 468 of bezel 362. One or more of containers 460, 462, 464 can also include one or more channels 470 configured to accommodate slidable interaction with a partition wall 472 so as to segregate the respective volumes 474, 476, 478 associated associated with containers 460, 462, 464. It should be appreciated that each of containers 460, 462, 464 can be configured to provide generally elongated volumes for acceptance of silverware, plastic ware, cup lids or the like and/or be partitioned to accommodate less elongate accessories, condiments, garnishes, etc.

Referring to FIGS. 24-25, each of dispensing containers 460, 462, 464 extend a respective depth, indicated by arrows 480, 482, between a respective top surface 484 and a respective bottom surface 486 to define a respective cavity 488 associated with each dispensing container 460, 462, 464. As shown in FIG. 25, depth 480 associated with dispensing containers 460, 462 is configured such that a bottom surface 486 associated with dispensing containers 460, 462 traverses the lateral member 420 associated with brace 358 without interfering therewith. In a preferred configuration, lateral member 420 of brace 358 can be configured to support an intermediary portion of respective containers 460, 462.

Unlike containers 460, 462, dispensing container 464 includes a generally downward opening channel 490 that slideably cooperates with a respective section of lateral member 420 of brace 358. Channel 490 partially segregates cavity 478 associated with dispensing container 464 along the longitudinal axis thereof. Channels 470 associated with dispensing container 464 are generally aligned with a partition 492 associated with the formation of cavity 478 such that the entire depth 482 of dispensing container 464 can be segregated into discrete longitudinal portions via the introduction of a partition wall 472 with container 464.

Figure 26:
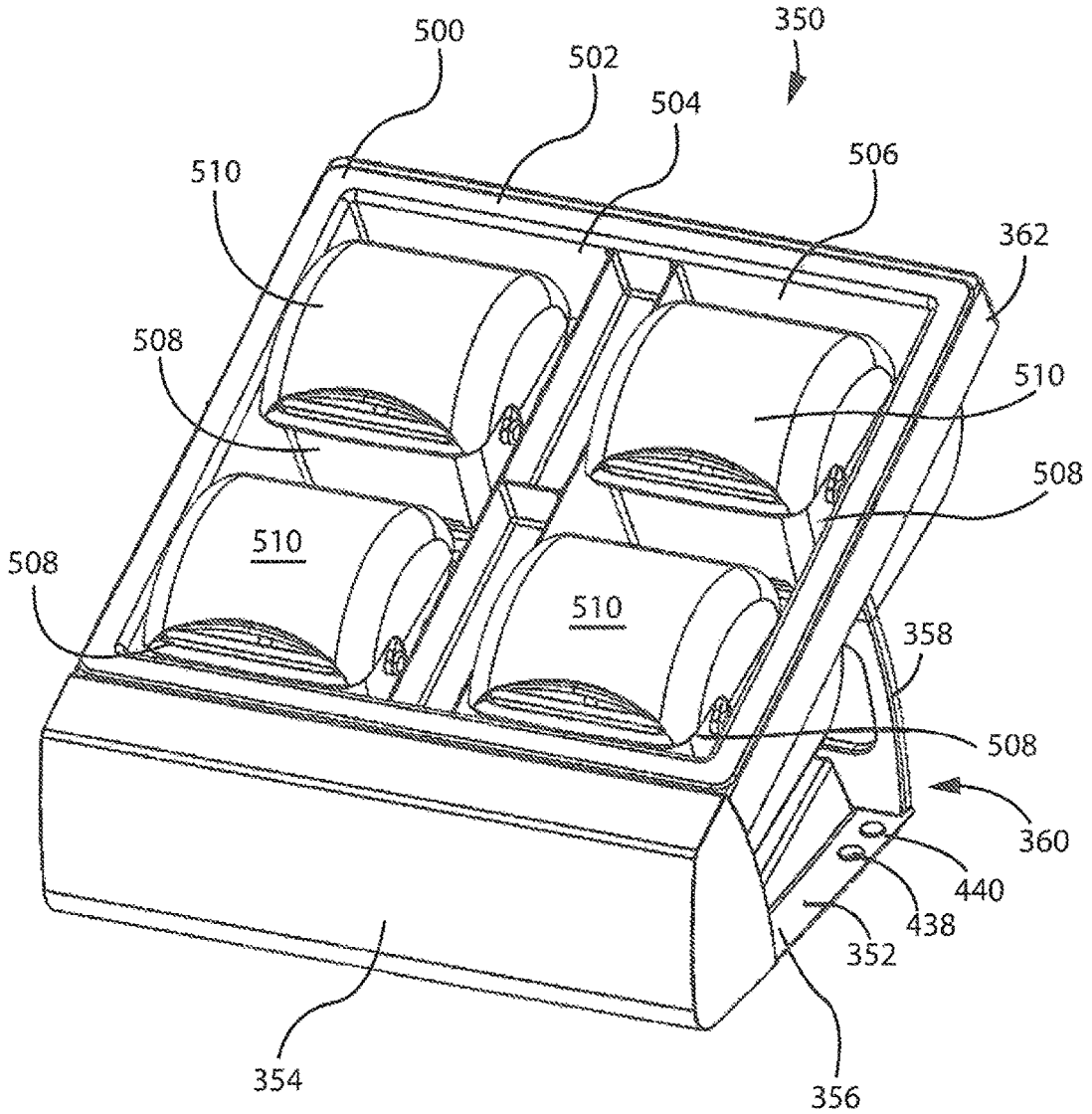
FIG. 26 is a view similar to FIG. 20 of another dispenser assembly useable with the dispenser system shown in FIG. 1.
Figure 27:
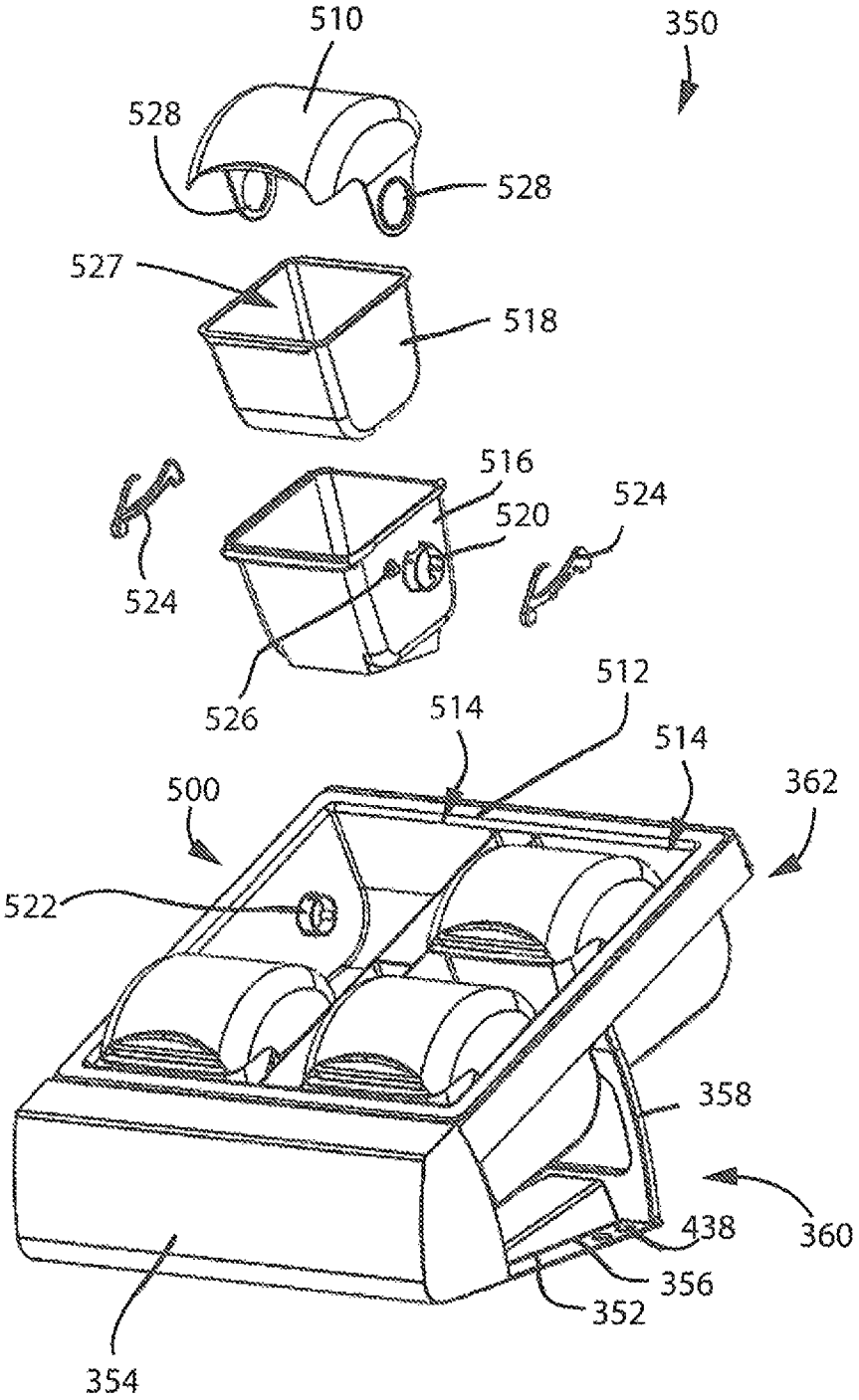
FIG. 27 is a view similar to FIG. 26 with one of the discrete dispenser containers exploded therefrom.

FIGS. 26 and 27 shown another alternate dispensing container arrangement or assembly 500 that is configured to removably cooperate with bezel 362 associated with dispensing assembly 350. Assembly 500 includes a faceplate 502 that includes one or more cavities 504, 506 that are constructed to removably cooperate with dispensing containers 508 and that each include a cover 510 that movably cooperates with a respective dispensing container 508.

Referring to FIG. 27, dispensing assembly 500 includes a housing or a bezel 512 that preferably removably cooperates with bezel 362 associated with base 352. Bezel 512 defines a plurality of cavities 514 that are shaped to removably cooperate with a receptacle 516 constructed to removably receive a dispensing container 518. It is further appreciated that cavities 514 could be provided in a generally closed configuration relative to the other cavities 514 defined by bezel 362 thereby facilitating the omission of discrete containers 518 and such that the respective cavities 514 define the discrete accessory containers. When provided in the configuration shown, receptacles 516 and bezel 512 include one or more bosses 520, 522 that are oriented at opposite lateral sides of the respective receptacle 516 or cavity 514 and facilitate the discrete removal of selected containers 518.

An operator 524 is associated with the opposite lateral sides of receptacle 516 and cooperates with a post 526 proximate the respective boss 520, 522. Operators 524 cooperate with cover 510 so as to preferably bias cover 510 toward a closed position wherein the respective cover 510 generally overlies an opening 527 defined by dispensing container 518. Each cover 510 includes a pair of openings 528 that are associated with the opposite lateral sides thereof and configured to cooperate with a respective boss 520, 522 to facilitate rotation of cover 510 relative to container 518 and/or a respective receptacle 516 defined by bezel 512. Cover 510 is rotatable about an axis defined by respective bosses 520, 522 and cooperates with operators 524 so as to allow the selective exposure of opening 526 defined by dispensing container 518.

Referring to FIGS. 20, 26, 27, it should be appreciated that bezels 364 and 512, interchangeably cooperate with bezel 362, such that dispensing assembly 350 can be configured to provide a plurality of dispensing containers such as dispensing containers 370, or dispensing containers having selectively operable covers such as dispensing assembly 500.

Referring to FIGS. 20-27, it is further appreciated that dispensing assembly 350 can be configured to provide various numbers of discrete dispensing containers as well as dispensing containers having different sized cavities associated therewith. That is, although dispensing container 476 (FIG. 24) can be configured to cooperate with generally elongated, accessories, such as silverware, plastic ware, etc., the cavity associated with dispensing container 476, can be quickly and conveniently configured, and/or partitioned to provide alternate sized receptacle cavities such that a plurality of generally similarly shaped cavities associated with dispensing container 474 (FIG. 24) can be provided.

It is further appreciated that dispensing assembly 350 can be configured to include one or more of the respective dispensing containers 474, 476, 478 in any discrete association with respect to base 352 and faceplate 354. Such considerations allows dispensing assembly 350 to be individually configured to satisfy the respective desires and/or demands of discrete users. It is further appreciated that one or more of bezels 362, 364 could be provided in widths wherein generally more square shaped dispenser containers 370, 518 cooperate with a generally more elongate configuration associated with dispensing containers 474, 476, 478 associated with a singular or discrete base 352 and/or corresponding faceplate 354.

Figure 28:
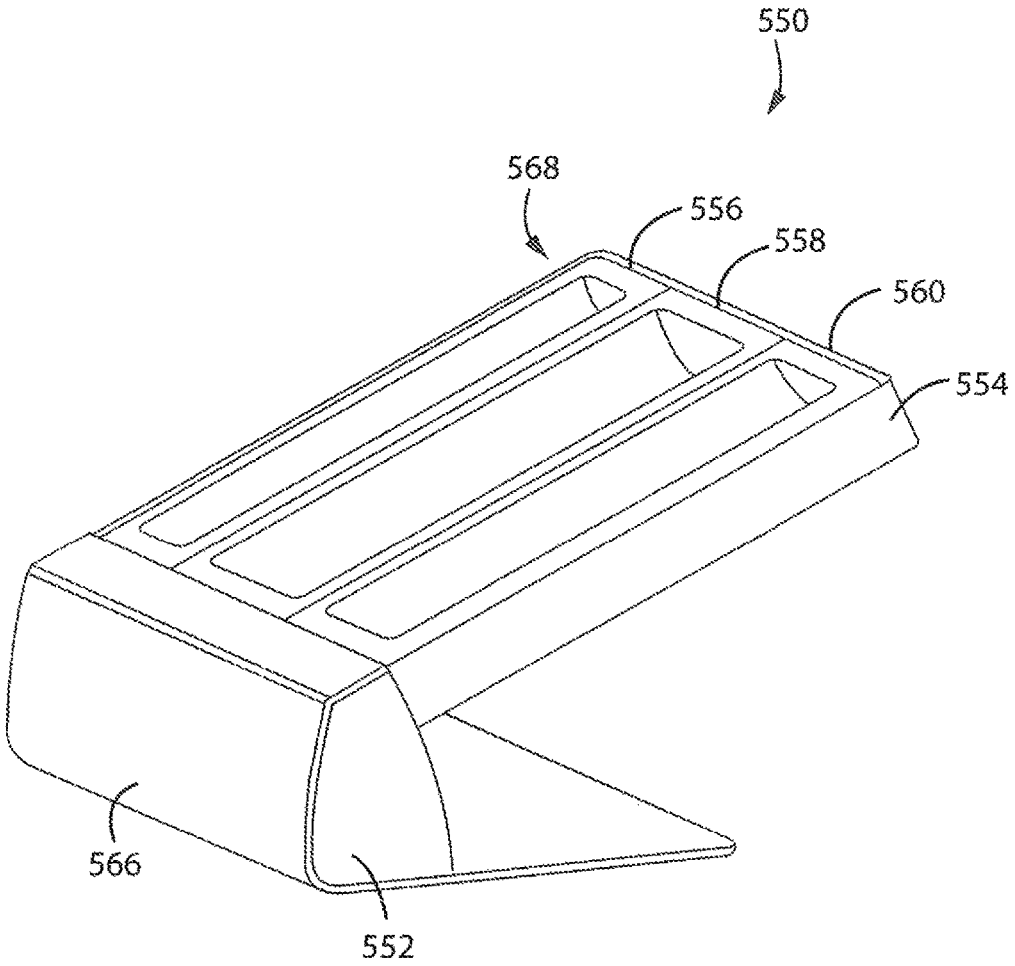
FIG. 28 is a perspective view of a dispenser assembly according to another embodiment of the invention that is useable with the dispenser system shown in FIG. 1.
Figure 29:
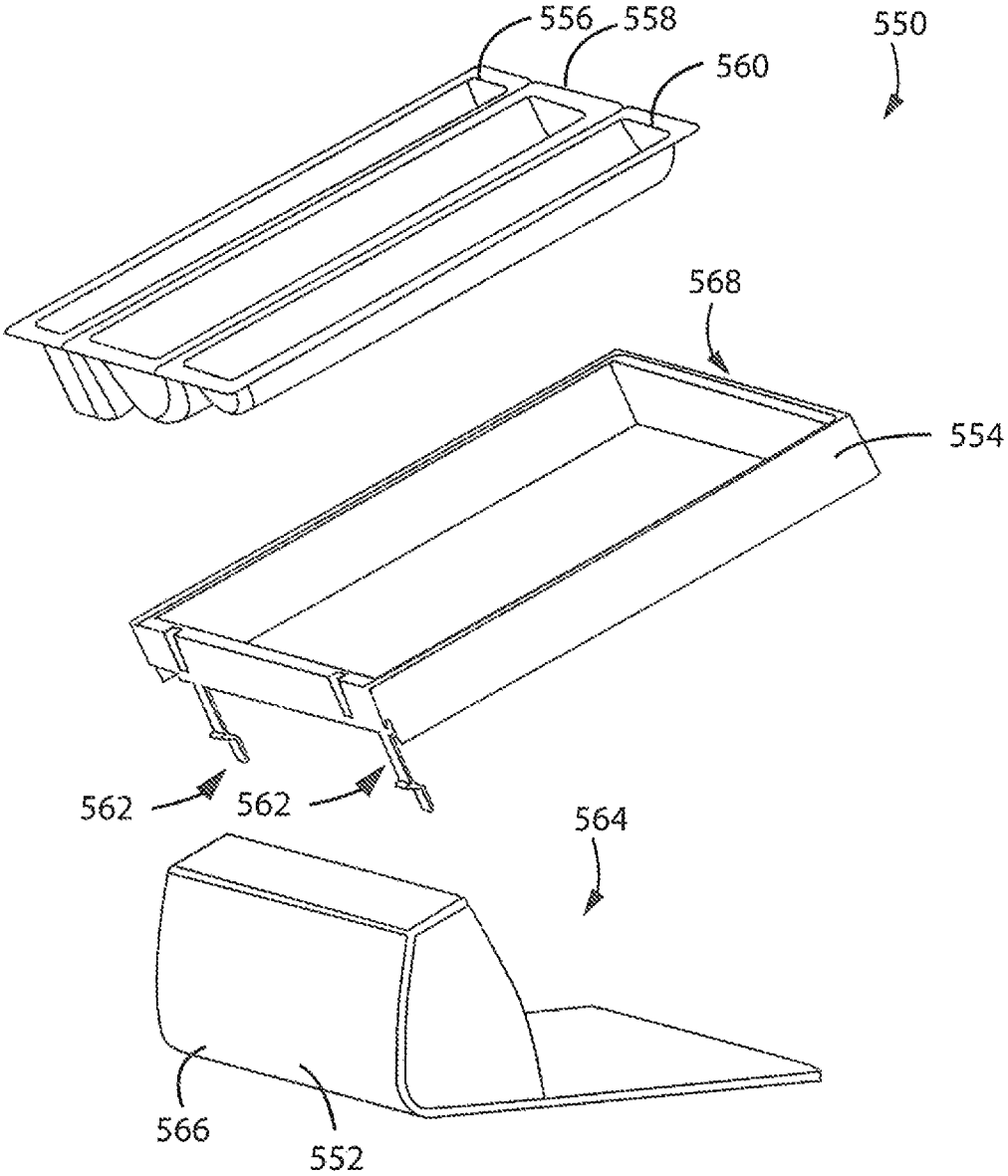
FIG. 29 is an exploded view of the dispenser assembly shown in FIG. 28.

FIGS. 28 through 31 show various alternate configurations associated with providing collapsible and/or discreetly configurable dispensing appliances. Referring to FIGS. 28 and 29, dispensing system 550 includes a base portion or a base 552 that is constructed to removably cooperate with a space frame or bezel 554 that removably cooperates with one or more dispensing containers 556, 558, 560. Bezel 554 includes one or more tabs 562 that preferably snap-fittingly cooperate with a rearward facing portion 564 associated with faceplate 566 of base 552. Bezel 554 defines an upward facing lip 568 that is shaped to accommodate resting or nesting of discrete dispensing containers 556, 558, 560, relative to bezel 554.

As shown in FIG. 28, when fully assembled, dispensing containers 556, 558, 560 are oriented in a generally rearward upwardly inclined orientation relative to faceplate 566. Preferably, dispensing system 550, and the discrete dispensing containers 556, 558, 560 associated therewith, are oriented at the same inclination relative to dispensing assembly 350. It is further appreciated that dispensing system 550 can include alternate laterally oriented connectors, such as connectors 438 associated with dispensing system 350, so as to allow lateral connection of multiple bases 552 relative to one another and/or bases having other constructions and/or dispensing accessories associated therewith.

Figure 30:
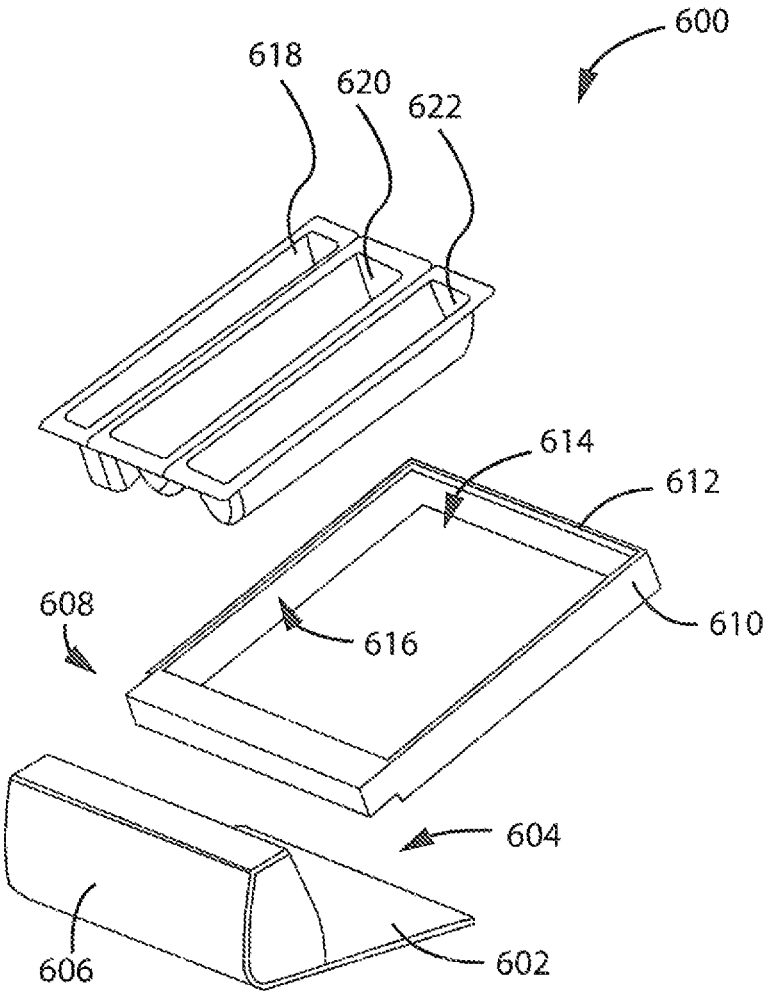
FIG. 30 is an exploded view of a dispenser assembly according to another embodiment of the invention and usable with the dispensing system shown in FIG. 1.

FIG. 30 shows a dispensing system 600 according to yet a further embodiment of the invention. Dispensing system 600 includes a base 602 generally similar to base 552 although base 602 is constructed with a rearward facing cavity 604 associated with faceplate portion 606 of base 602. Cavity 604 is shaped to slideably cooperate with a forward facing portion 608 of a space frame or bezel 610 a system 600. Generally upward facing surface 612 of bezel 610 defines a cavity 614 that is bounded by a channel 616. Channel 616 of bezel 610 is shaped to removably cooperate with a plurality of discrete dispensing containers 618, 620, 622 in a manner similar to the dispensing systems described above.

It is further appreciated that dispensing system 600 can be configured to cooperate with a plurality of generally elongate dispensing containers 618, 620, 622 or discrete dispenser containers having other shapes as described heretofore and in a manner that allows dispensing system 600 to be individually configured to provide a desired number, and/or orientation of discrete dispensing containers. It is further appreciated that base 602 of dispensing system 600 can include alternate laterally oriented connectors such as connectors 438 to accommodate the lateral securing of adjacent bases 602, and the corresponding dispensing containers, relative to one another during implementation in a food services environment.

Figure 31:
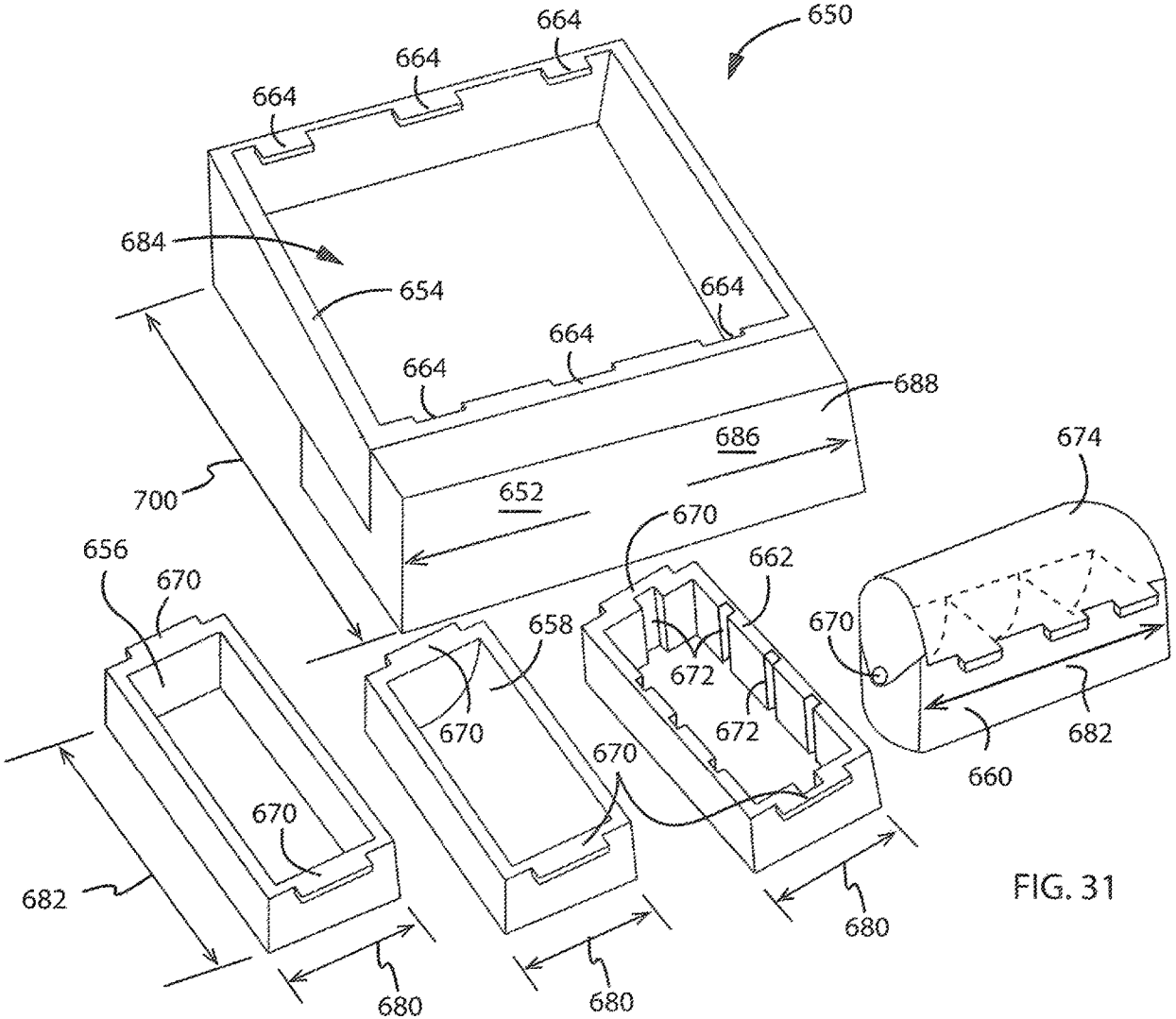
FIG. 31 is a partially exploded view of a dispenser system that includes various dispenser containers and which is useable with the dispenser system shown in FIG. 1.

FIG. 31 shows a dispensing system 650, according to a further embodiment of the invention. Dispensing system 650 includes a base 652 that is constructed to removably cooperate with a space frame or bezel 654 that is constructed to removably cooperate with one or more discrete dispensing containers 656, 658, 660, and/or one or more discrete space frames or bezels 662 that are shaped to cooperate with alternate dispensing containers.

Bezel 654 includes one or more recesses or cavities 664 that are oriented at opposite lateral or longitudinal orthogonal ends or sides of base 652. Dispensing containers 656, 658, 660 include respective projections 670 that are oriented at opposite orthogonal sides thereof and shaped to slideably cooperate with the respective cavities 664 defined by bezel 654. It is appreciated that the interfering engagement associated with cavities 664 and projections 670 could be provided in any number of shapes, and/or configurations such as interfering rails and cavities, mortise and tenon type joints, dovetail type joints. It is further appreciated that dispensing system 650 can include a second bezel 662 includes one or more cavities or recesses that are shaped to slideably accommodate alternate dispensing containers. It is further appreciated that second bezel 662 can be provided as a partitionable dispenser container as disclosed above by including a bottom or floor associated therewith. Whether provided as a second bezel or an additional dispenser container, bezel 662 can include one or more projections 670 that can slideably cooperate with a respective pair of cavities 664 defined by bezel 654 associated with base 652.

Projections 670 associated with dispensing container 660, which includes one or more translatable cover(s) 674, can be slideably associated with recesses 672 oriented at the opposite longitudinal ends associated with bezel 654 or bezel 662 such that dispensing system 650 can be configured to include a selectively openable dispensing container, such as dispensing container 660, and a plurality of generally more fixed shape dispensing containers such as dispensing containers 656, 658. It is further appreciated that the laterally oriented recesses 672 associated with bezel 662, can be constructed to slideably cooperate with a corresponding boss of a plurality of discrete dispensing containers and/or dispensing container containers, such as receptacle 516 associated with dispensing system 350 (FIG. 27). The generally elongated shape of dispensing container 656, 658 renders such containers particularly suitable for storage of elongated, accessories, such as silverware, plastic ware, straws, cup lids, or the like, whereas dispensing container 660 is more particularly configured to dispense discrete condiments and/or garnishes.

It is further appreciated that one or more of dispensing containers 656, 658, 660 can be provided in various desired widths, as indicated by arrow 680, and lengths, as indicated by arrow 682, to facilitate the selectively removable cooperation of the discrete dispenser containers with the cavity 684 defined by bezel 654 of dispensing system 650. Preferably, the respective dispensing containers that define a generally elongated volume associated therewith are provided in widths of approximately 6 inches and lengths of approximately 18 inches relative to the exterior dimensions thereof. Such a consideration allows various sized respective dispensing container accessories to be associated with the bezel 654 of dispensing system 650 and to be oriented in lateral or longitudinal orientations relative to forward facing surface 686 associated with faceplate 688 of base 652. Preferably, each of dispensing systems 50, 350 550, 600, 650 are provided in a length 700 relative to a rearward extending direction that satisfies American's with Disability Act (ADA) reach requirements so as to facilitate efficient and convenient utilization of the respective dispensing systems by all classes of users and/or consumers.

Understandably, it is appreciated that each of the bases and the dispensing accessories of system 50 can be provided in various aesthetic appearances, configurations, and/or paradigms such as wood grained, bamboo, stainless steel, other materials, complementary color and material schemes, etc. such that the corresponding accessory dispensing system, when deployed with the desired dispensing accessories, generally correlates or compliments the objectives and design tastes of those deploying system 50 and/or the environment associated with the deployment of the respective accessory dispensing system.

It is further appreciated that the dispensing accessories described heretofore are merely exemplary of some of the more commonly deployed food service related accessories and that it is envisioned that system 50 can be readily configured for use in various environments, with other accessories, and/or accessories constructed for dispensing of other food stuff or food consumption accessories, sanitation products, condiments, garnishes, etc. It is further envisioned and appreciated that the modularity associated with the plurality of bases and the corresponding accessory dispensing systems can be configured to generate a plethora of food service dispensing arrangements or systems to satisfy the various demands associated with any given environment. These and other aspects of the present invention will be further appreciated from the appending claims.

It is also to be understood that, although the foregoing description and drawings describe and illustrate in detail one or more embodiments of the present invention, to those skilled in the art to which the present invention relates, the present disclosure will suggest many modifications and constructions as well as widely differing embodiments and applications without thereby departing from the sprit and scope of the invention. The present invention, therefore, is intended to be limited only by the scope of the appended claims and the applicable prior art.

What is claimed is:

1. A food services accessory dispensing system comprising:

a first base portion;

a plurality of dispensing containers that are each configured to dispense a different food service accessory, each of the plurality of dispensing containers being constructed to removably cooperate with the first base portion;

a second base portion constructed to removably cooperate with the first base portion and constructed to cooperate with at least one of the plurality of dispensing containers and wherein each alternate lateral end of each of the first base portion and the second base portion have the same shape;

a first opening and a second opening formed in the first base portion;

a first opening and a second opening formed in the second base portion; and at least one connector having a first end and a second end, wherein the first end is releasably insertable into each of the first and second openings formed in the first base portion or the second base portion and the second end is releasably insertable into each of the first and second openings formed in the first base portion and the second base portion for selectively connecting the first base portion and the second base portion to one another when the connector is engaged with a respective one of the first and second openings in the first base portion and a respective one of the first and second openings in the second base portion when the respective lateral ends of the first base portion and the second base portion are directly adjacent one another.

2. The food services accessory dispensing system of claim 1 wherein at least one of the first base portion and the second base portion includes an opening that is constructed to cooperate with a napkin dispenser such that an opening of the napkin dispenser is aligned with the opening in the base portion.

3. The food services accessory dispensing system of claim 1 wherein the plurality of dispensing containers are presented in a forward facing declining orientation.

4. The food services accessory dispensing system of claim 1 wherein at least one of the first base portion and the second base portion are constructed to concurrently support more than one of the plurality of dispensing containers.

5. The food services accessory dispensing system of claim 1 further comprising an overlay associated with an outward facing surface of at least one of the first base portion, the second base portion, and at least one of the plurality of dispensing containers.

6. The food services accessory dispensing system of claim 1 wherein alternate ends of the connector are connected to one of the first base portion and the second base portion when not in use.

7. The food services accessory dispensing system of claim 1 wherein the first base portion and the second base portion are constructed to physically cooperate with at least one of the plurality of dispensing containers such that a respective dispensing container is presented in a dispensing orientation.

8. The food services accessory dispensing system of claim 1 wherein more than one of the first base portion, the second base portion, and the plurality of dispensing containers exposed to a service environment have a common aesthetic appearance.

9. The food services accessory dispensing system of claim 1 wherein at least one of the first base portion and the second base portion includes a bezel that removable cooperates with a respective one of the first base portion and the second base portion and is constructed to support each of the plurality of dispensing containers associated with the respective one of the first base portion and the second base portion.

10. A method of presenting food service consumer materials, the method comprising:

providing a plurality of interconnectable base modules;

providing a plurality of dispensing modules that are configured to contain and dispense consumer food service materials and that are each constructed to cooperate with at least one of the plurality of interconnectable base modules;

providing a bezel that is constructed to removably cooperate with the base module and support the plurality of dispensing modules; and providing a brace that cooperates with at least one of the interconnectable base modules and at least one of the bezel and at least one of the plurality of dispensing modules.

11. The method of claim 10 further comprising providing at least one of the plurality of the interconnectable base modules and the plurality of dispensing modules in more than one user selectable aesthetic appearance.

12. The method of claim 10 further comprising providing a connector constructed to removably cooperate with at least two of the interconnectable base modules to secure the at least two interconnectable base modules relative to one another.

13. The method of claim 12 further comprising forming each of the plurality of interconnectable base modules to support opposite ends of the connector when the connector is not engaged with another base module.

14. The method of claim 10 further comprising orienting an end portion of the brace near an end portion of a respective at least one of the interconnectable base modules.

15. The method of claim 14 further comprising orienting another end portion of the brace at a location offset from generally opposite longitudinal ends of the respective bezel.

16. The method of claim 10 further comprising configuring the plurality of dispensing modules to accommodate at least one of a food stuffs accessories including utensils, straws, container accessories, a disposable paper product, a garnish, and a condiments.

17. A modular food services dispensing system comprising:

a base;

a space frame constructed to removably cooperate with the base such that the space frame is oriented at an inclined orientation relative to a rearward direction and relative to the base;

at least one dispensing container constructed to removably cooperate with the space frame;

a brace engaged with the base and extending in a generally upward direction between the base and the space frame;

another base having a shape similar to the base such that generally opposite lateral sides of the base and another base have a similar shape; and a connector configured to selectively engage one of the base and another base laterally inboard of a respective lateral side of one of the base and the another base when not in use and each of the base and another base when in use to secure the base and another base at laterally adjacent positions relative to one another.

18. The modular food services dispensing system of claim 17 wherein the brace removably cooperates with the base and the space frame.

19. The modular food services dispensing system of claim 17 further comprising a cover that is movable relative to the at least one dispensing container to selectively expose a volume defined by the at least one dispensing containers.

20. The modular food service dispensing system of claim 17 further comprising another dispensing container constructed to interchangeably cooperate with the space frame and having a shape different than the dispensing container.

* * * * *